United States Patent [19]

Yamamoto et al.

[11] Patent Number: 4,797,183

[45] Date of Patent: Jan. 10, 1989

[54] ELECTROPLATED COMPOSITE OF ZINC AND ORGANIC POLYMER

[75] Inventors: Yuzo Yamamoto, Wakayama; Hiroyuki Nagamori, Utsunomiya; Kozo Kitazawa, Wakayama, all of Japan

[73] Assignee: Kao Corporation, Tokyo, Japan

[21] Appl. No.: 107,368

[22] Filed: Oct. 9, 1987

[30] Foreign Application Priority Data

Oct. 17, 1986 [JP] Japan ..... 61-247093

[51] Int. Cl.[4] ..... C25D 15/00; 204 16; 204 55.1

[52] U.S. Cl. ..... 204/16; 204/55.1

[58] Field of Search ..... 204/16, 55.1

[56] References Cited

U.S. PATENT DOCUMENTS 3,461,044 8/1969 Lyons ..... 204/3

3,677,907 7/1972 Brown ..... 204/16

*Primary Examiner*—T. M. Tufariello

*Attorney, Agent, or Firm*—Flynn, Thiel, Boutell & Tanis

[57] ABSTRACT

An electroplated composite coating of the invention which comprises 70 to 99.9 percent by weight of zinc or an alloy of zinc and 0.1 to 30 percent by weight of an organic polymer, said polymer being soluble in water and anionic, cationic or amphoteric, having been dispersed in the electroplated crystal grains or gain boundaries of the zinc and/or the zinc alloy, having a weight-average molecular weight of 1,000 to 1,000,000, said polymer having at least one aromatic ring and 1 to 10 hydroxyl group on the average per a molecular weight unit of 500, said polymer containing therein a polar group selected from the group consisting of:

sulfo group, a phosphoric acid group of the formula —O—OP-(OR)2, a phosphorous acid group of the formula —O—P-(OR)2, a phosphonic acid group of the formula —PO(OR)2, a phosphonous acid group of the group —P(OR)2, a phosphinic acid group of the formula —RPO(OR), a phosphinous acid group of the formula —PR(OR), a tertiary amino group of the formula —NR1R2, a quaternary ammonium group of the formula —NR1R2R3X and carboxyl group having the formula —COOH, in which R is hydrogen or a hydrocarbon group and R1, R2 and R3 each are a straight or branched alkyl, a straight or branched hydroxyalkyl, an aromatic ring and X is a counter anion, the sulfo group being contained therein on the average in an amount of 0.1 to 4 groups per a molecular weight unit of 500, the other groups being contained therein on the average in a total amount of 0.1 to 5 groups per a molecular weight of 500, the main chain bridging between two aromatic rings being at least one of C-C linkage, C=C linkage and an ether linkage (C-O-C).

17 Claims, 6 Drawing Sheets

FIG. 6 (a) UTW ANALYSIS
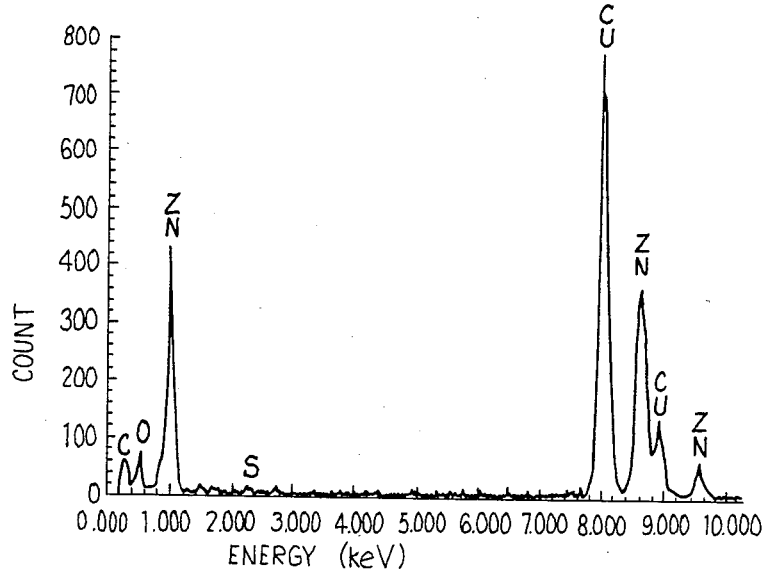
FIG. 6 (b) EELS ANALYSIS
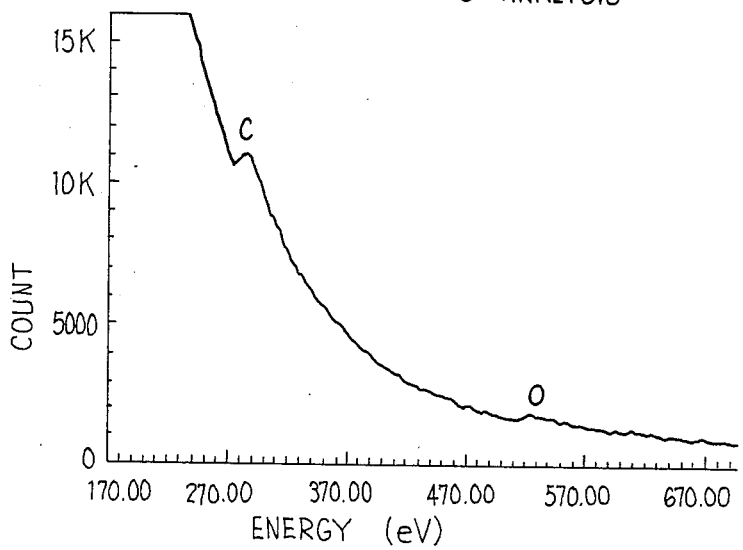

FIG. 7(a) UTW ANALYSIS
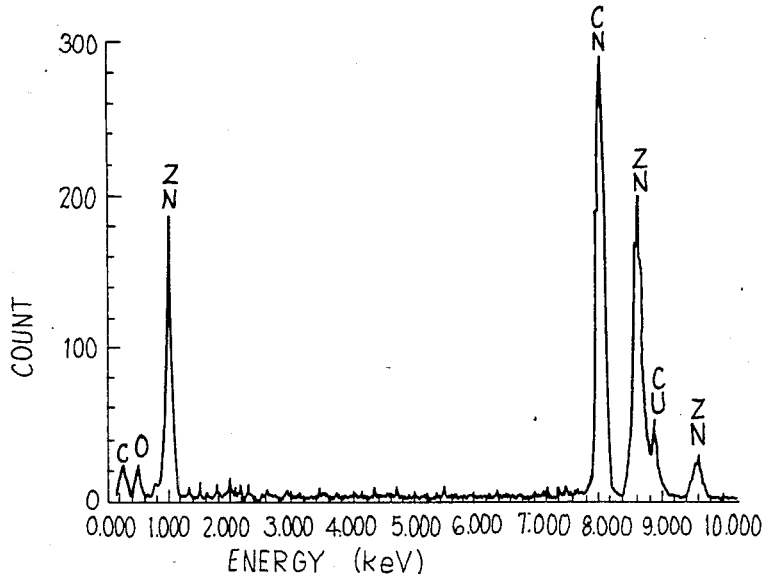
FIG. 7(b) EELS ANALYSIS
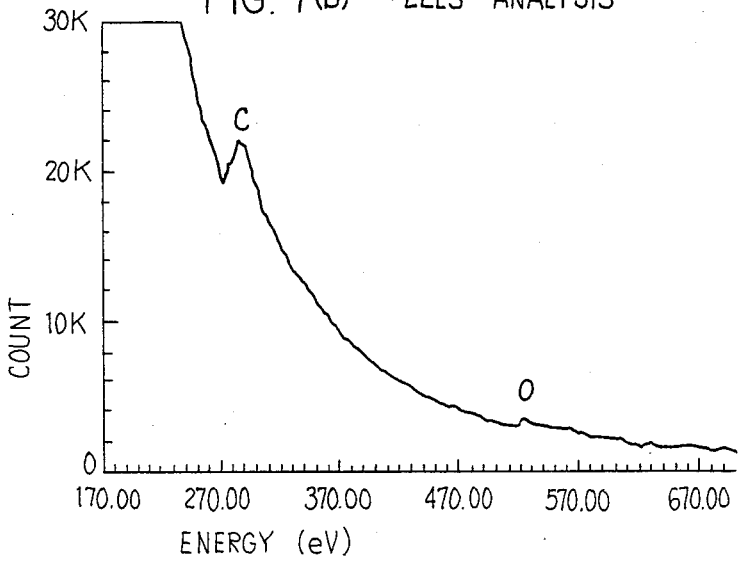

ELECTROPLATED COMPOSITE OF ZINC AND ORGANIC POLYMER

The present invention relates to new electroplated coatings and a process for preparing them.

More particularly, the present invention relates to a zinc plating provided with excellent properties such as adhesion to paint, corrosion resistance before or after coating, weldability and press workability, a process for preparing the coating and a plated metallic material comprising zinc or a zinc alloy and an organic polymer in the coating.

[Prior Art]

Metal surfaces, particularly steel plate surfaces, are plated with zinc or a zinc alloy so as to make them beautiful and corrosion-resistant. Among them, a tendency to plate automobile steel plttes with zinc or a zinc alloy is now developing to prevent rusting of them, since the automobiles are used under severe conditions because salt is spread for melting snow.

The plated metal materials are often further painted so as to improve their corrosion resistance or to make them beautiful. However, the surface of the plated metal coating such as zinc or zinc alloy coating has generally only a poor adhesion to paints and, therefore, it is usually treated to form a prime coat prior to the painting. Various processes for the pretreatment have been proposed and practically employed. Typical examples of them include chemical processes (conversion processes) such as a phosphate treatment process or a chromate treatment process wherein a chromic acid solution is used; and physical processes wherein the surface is roughened by sand blasting or grit blasting. These processes are socalled surface condition controlling processes wherein an increase in the available adhesion surface area and anchor effect are mainly expected.

On the other hand, plated coatings which necessitate no primary coat are investigated. For example, a dispersion plating process was proposed wherein a water-insoluble resin is dispersed in a plating bath to conduct codeposition (U.S. Pat. Nos. 3,434,924 and 3,461,044). In this process, the affinity of the coating for the paint is increased by forming a composite coating of a metal and a resin.

The above-mentioned conversion processes such as phosphate treatment and chromate treatment processes have, however, problems in the schedule control and prevention of environmental pollution. Namely, the phosphate treatment which is most popularly employed for forming the primary coat prior to the painting of a metallic material plated with zinc has restrictions and problems such as the length of the operation (6 to 9 steps), complicated control of the bath and disposal of sludges and waste liquids formed in large quantities. The chromate treatment process has an intrinsic defect that the adhesion of the plated coating to a paint is not necessarily good in addition to problems, i.e. toxicity of chromium and treatment of the waste liquid.

The inorganic oxide layer formed by the chemical treatment as mentioned above has a defect that it is not resistant to a severe press working.

It is difficult to provide a fine, complicated roughness sufficient for obtaining the anchor effect over a large area by the physical treatment such as sand blasting.

Although the dispersion plating process with a water-insoluble resin is a noteworthy technique, it has many problems that the homogeneous dispersion of the resin particles and stabilization of the dispersion are difficult, that the scale enlargement is quite difficult, or in other words, the uniorm plating of a steel belt having a large surface area is difficult and, in addition, it has problems also in the physical properties of the product such that the paint adhesion is not always sufficient and press workability thereof is poor.

As described above, steel sheets having a high adhesion to paints and excellent rust-proofing property are eagerly demanded because durability over a long period of time is recently required of particularly rust-proof steel sheets used in forming automobile bodies.

SUMMARY OF THE INVENTION

An object of the present invention is to provide a multifunctional plated coating capable of exhibiting, without a prime coat, excellent adhesion to paints, corrosion resistance, weldability and press workability by overcoming the defects of conventional plated zinc coatings and priming treatments. After intensive investigations of ideal chemical properties and ideal surface conditions (surface roughness, crystal grain diameter and shape thereof) of the plated coating, departing from ordinary ideas, such as control of the elements forming the alloy and improvement in or relating to the pretreatment such as the conversion or blasting treatment, the inventors have found that the above-described object of the invention can be attained by controlling the diameter and shape of the crystal grains with a water-soluble organic polymer having a specified chemical structure and incorporating a specified water-soluble organic polymer in a plating matrix to form a composite. The present invention has been completed on the basis of this finding.

An electroplated composite coating of the invention which comprises 70 to 99.9 percent by weight of zinc or an alloy of zinc and 0.1 to 30 percent by weight of an organic polymer, said polymer being soluble in water and anionic, cationic or amphoteric, having been dispersed in the electroplated crystal grains or gain boundaries of the zinc and/or the zinc alloy, having a weight-average molecular weight of 1,000 to 1,000,000, said polymer having at least one aromatic ring and 1 to 10 hydroxyl group on the average per a molecular weight unit of 500, said polymer containing therein a polar group selected from the group consisting of:

a sulfo group, a phosphoric acid group of the formula —O—PO-(OR)2, a phosphorous acid group of the formula —O—P-(OR)2, a phosphonic acid group of the formula —PO(OR)2, a phosphonous acid group of the group —P(OR)2, a phosphinic acid group of the formula —RPO(OR), a phosphinous acid group of the formula —PR(OR), a tertiary amino group of the formula —NR1R2, a quaternary ammonium group of the formula —NR1R2R3.X and carboxyl group having the formula —COOH, in which R is hydrogen or a hydrocarbon group and R1, R2 and R3 each are a straight or branched alkyl, a straight or branched hydroxyalkyl, an aromatic ring and X is a counter anion, the sulfo group being contained therein on the average in an amount of 0.1 to 4 groups per a molecular weight unit of 500, the other groups being contained therein on the average in a total amount of 0.1 to 5 groups per a molecular weight of 500, the main chain bridging between two aromatic rings being at least one of C—C linkage, C=C linkage and an ether linkage (C—O—C).

The composite coating may contain two or more kinds of the organic polymers and the organic polymer may have two or more polar groups. The organic polymer is preferably dispersed uniformly in the zinc and zinc alloy.

The invention further provides a process for preparing the composite coating and a metallic article which has been electroplated with the composite coating.

The polar group to include in the organic polymer is defined to include a sulfo group and phosphoric acid groups

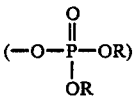

(R being a hydrogen atom or a hydrocarbon group; the same shall apply hereinafter), phosphorous acid groups (—O—P(OR)—OR), phosphonic acid groups (—P(=O)(OR)—OR)

phosphonous acid groups (—P(OR)—OR), phosphinic acid groups (—P(=O)(OR)—R), phosphinous acid groups (—P(OR)—R), tertiary amino groups (—N(R1)(R2)), quaternary ammonium bases (—N+(R1)(R2).X−(R3))

(in which $R_1$, $R_2$ and $R_3$ are the same or different and they each represent a straight-chain or branched alkyl or hydroxyalkyl group or an aromatic group such as phenyl or benzyl group and X represents a counter anion) and carboxyl group (—COOH) as indispensable components, Moreover there is provides in the invention a process for preparing a composite coating of the orgainic polymer and the electroplated zinc or zinc alloy, characterized by that a conductive substrate as a cathode is electroplated in a plating bath to codeposit a metal and a water-soluble organic polymer on the surface of the substrate, the amount of the water-soluble organic polymer being adjusted to 0.1 to 30 wt. % based on the total codeposit and the plating bath being a zinc plating bath *containing 10 to 600 g/l of zinc ion or a zinc alloy plating* bath containing one or more metals other than zinc each in an amount of 1 to 600 g/l in addition to zinc, which plating bath further contains as indispensable component(s) 2 to 200 g/l in total of at least one of the above-mentioned anionic, cationic or amphoteric water-soluble organic polymer; and a plated metallic material comprising a metallic material such as a steel plate or a copper plate having a composite coating of the organic polymer and the electroplated zinc and/or zinc alloy, formed thereon, which coating contains 0.1 to 30 wt. %, based on the total plating, of at least one of the above-mentioned anionic, cationic and amphoteric water-soluble organic polymers.

According to the present invention, the diameter and shape of the crystal grains are controlled (to make the grains smaller and to provide surface roughness) by selecting the fundamental skeleton (aromatic ring and hydroxyl group) of the water-soluble organic polymer, kind of the polar group (for example, sulfo group), molecular weight (1,000 to 1,000,000) and amount thereof to be added to the plating bath (2 to 200 g/l) so as to increase the available adhesion area and to provide a suitable surface as the prime coat. A suitable amount of the specified water-soluble organic polymer is combined with the metal to form a molecular composite to increase the affinity of the electroplated coating surface for a paint and the reactivity (bonding strength) of them irrespective of the surface shape of the coating and to improve the rust-proofing property and weldability by the effects of the composite organic polymer.

The water-soluble organic polymers usable in the present invention include those of the following two groups a and b: the group a includes water-soluble organic polymers having a weight-average molecular weight of 1,000 to 1,000,000, at least one aromatic ring, 1 to 10 hydroxyl groups on average and 0.1 to 4 sulfo groups on average for a molecular weight unit of 500 as indispensable components, wherein the main chain bonding the aromatic rings together is at least one of C—C linkage, C=C linkage and ether linkage (C—O—C). The group b includes water-soluble anionic organic polymers having a weight-average molecular weight of 1,000 to 1,000,000, at least one aromatic ring having at least one hydroxyl group is substituent(s)

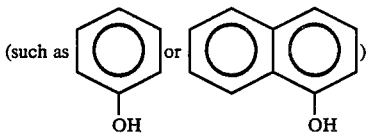

and 0.1 to 4 sulfo groups on average for a molecular weight unit of 500, wherein the main chain bonding the aromatic rings together is at least one of C—C linkage, C=C linkage and ether linkage (C—O—C).

The term "main chain bonding the aromatic rings together, i.e. C—C linkage, C=C linkage or ether bond (C—O—C)" herein refers to poly-p-hydroxystyrene, sodium ligninsulfonate, nitrohumic acid, etc. Condensed rings (such as 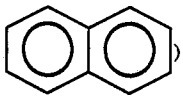 )

are not deemed to have any of the above-mentioned linkages in the main chain according to the above definition in the present invention.

The water-soluble organic polymers in the groups a and b can contain a halogen atom such as Cl or Br or a functional group other than the above-mentioned ones, such as a nitrile, nitro or ester group.

Examples of the water-soluble organic polymers satisfying the conditions of the groups a and b include the following compounds A-1) to A-11):

(A-1) sulfonates of phenol-formaldehyde resin such as novolak resin, phenol-furfural resin, resorcinol-formaldehyde resin and their derivatives;

(A-2) sulfonates of epoxy resin derivatives such as epoxy resin having a bisphenol A skeleton, epoxy acrylate and phenol $(EO)_5$ glycidyl ether; and formalin condensates of sodium bisphenol A sulfonate and sodium bisphenol S sulfonate;

(A-3) polyhydroxyvinylpyridine sulfonates;

(A-4) formalin condensate salts of sulfonates of alkylphenols and their derivatives such as creosote oil sulfate/formalin condensate salts, m-cresol methylenesulfonate/formalin condensate, formalin condensate of sodium m-cresol bakelite methylenesulfonate/Schäffer's salt and formalin condensate of 2-(2'-hydroxyphenyl)-2-(2'-hydroxy)sulfomethylpropane; and salts of formalin condensates of phenols and phenolic carboxylic acids. The phenols include, for example, phenol, o-cresol, m-cresol, p-cresol, 3,5-xylenol, carvacrol, thymol, catechol, resorcinol, hydroquinone, pyrogallol and phloroglucinol.

The phenolic carboxylic acids include, for example, salicylic acid, m-hydroxybenzoic acid, p-hydroxybenzoic acid, protocatechuic acid, gentisic acid, α-resorcylic acid, β-resorcylic acid, γ-resorcylic acid, orsellinic acid, caffeic acid, umbellic acid, gallic acid and 3-hydroxyphthalic acid;

(A-5) formalin condensates of sulfonates of mono- or polyhydroxynaphthalenes and their derivatives; wherein examples of the monohydroxynaphthalenes include α-naphthol and β-naphthol and those of the polyhydroxynaphthalenes include α-naphthohydroquinone (1,4-dihydroxynaphthalene), β-naphthohydroquinone (1,2-dihydroxynaphthalene), naphthopyrogallol (1,2,3-trihydroxynaphthalene) and naphthoresorcinol (1,3-dihydroxynaphthalene);

(A-6) formalin condensates of phenylphenolsulfonates;

(A-7) dihydroxydiphenylsulfone/formalin condensates such as bis(hydroxyphenyl)sulfone.naphthalenesulfonate/formalin condensate, bis(hydroxydiphenyl)sulfone monomethylsulfonate/formalin condensate and hydroxydiphenylsulfone monosulfonate/formalin condensate;

(A-8) sulfonates of poly-p-hydroxystyrene and polyhydroxystyrene derivatives such as brominated poly-p-hydroxystyrene, poly-p-hydroxymethoxystyrene and poly-p-hydroxydimethoxystyrene;

(A-9) ligninsulfonic acid and ligninsulfonates which are compounds obtained by treating a waste liquor formed as a by-product in the production of pulp and which mainly comprise ligninsulfonates or ligninsulfonic acid.

The chemical structure of lignin is a three-dimensional reticulate structure comprising a phenylpropane group as the fundamental skeleton.

Various ligninsulfonic acids and ligninsulfonates are prepared and put on the market by many pulp making companies. They have a molecular weight ranging from 180 to 1,000,000 and various degrees of sulfonation and their products include various salts, chemically modified products and products having a controlled heavy metal content. It cannot be said that all of these ligninsulfonic acids and their salts are effective in attaining the object of the present invention. The effects of them are various. The object of the present invention can be attained to the maximum degree when a specified ligninsulfonic acid or its salt is used. Thus, the preferred ligninsulfonic acids and their salts usable in the present invention are limited. Namely, those satisfying all of the following conditions (1) to (3) are preferred in the present invention: (1) those from which low-molecular components having a molecular weight of lower than 1,000 or high-molecular components having a molecular weight of higher than 100,000 have been removed by an industrial process or those which contain only a very small amount of components having a molecular weight of lower than 1,000 or higher than 100,000 and a peak of the molecular weight distribution in the range of 1,000 to 100,000 and in which at least 50% of the components are within this molecular weight range.

(2) those having a sulfo group density (degree of sulfonation) of 0.6 to less than 3 on average for a molecular weight of 500, and (3) those in which the number of carboxyl groups is not increased artifically by an oxidation treatment.

The kinds of salts of ligninsulfonic acids are not particularly limited. They include, for example, Na, K, Ca, ammonium, Cr, Fe, Al, Mn and Mg salts. Among them, those satisfying the above described conditions (1) to (3) are preferred.

Further, ligninsulfonic acids and ligninsulfonates chelated with a heavy metal ion such as Fe, Cr, Mn, Mg, Zn or Al can also be used in the present invention. Among them, those satisfying the above described conditions (1) to (3) are preferred.

In addition, ligninsulfonic acid adducts and ligninsulfonate adducts with another organic compound such as naphthalene or phenol or organic polymers can also be used in the present invention. Among them, those satisfying the above described conditions (1) to (3) are preferred. The ligninsulfonic acids and their salts usable in the present invention may contain impurities incorporated therein in the course of pulp manufacture. However, those containing smaller amounts of the impurities are preferable.

The amount of the ligninsulfonic acids and their salts to beaadded to the plating bath is in the range of 2 to 200 g/l excluding the impurities, preferably 3 to 100 g/l and most preferably 5 to 50 g/l. Although very small crystals can be obtained and the electroplated coating surface can be roughened to some extent with less than 2 g/l of the ligninsulfonic acid or its salt, the chemical properties (adhesion to the paint) of the coating surface can not be improved sufficiently in such a case. On the contrary, when it exceeds 200 g/l, the electroplated coating becomes brittle and its workability is deteriorated unfavorably. With 2 to 200 g/l of the ligninsulfonic acid or its salt, the primary and secondary adhesions equal or are superior to those provided by the phosphate treatment which has been the most excellent primary coating treatment can be provided. With 3 to 100 g/l thereof, the primary adhesion, secondary (water-resistant) adhesion and corrosion resistance after painting far superior to those provided by the phosphate treatment can be provided. With 5 to 50 g/l thereof, a remarkable improvement in or relating to not only the primary adhesion and the secondary adhesion but also corrosion resistance after painting can be easily developed.

The present invention is characterized in that the intended effects can be obtained easily by adding a water-soluble organic polymer such as ligninsulfonic acid or its salt solely to the plating bath. According to the present invention, the incorporation of additives such as the first brightener, second brightener and third brightener (quick brightener) is essentially unnecessary. Rather ordinary brighteners such as gelatin, saccharin, molasses, polyethylene glycol, polyethylene glycol nonylphenyl ether, benzoquinone, oleic acid and fluorotriacetic acid might seriously deteriorate the effects of the present invention.

The above-described limitations are provided, since the factors in the above conditions (1) to (3) exert quite significant influences on the improvement in the adhesion to paint and corrosion resistance, reduction in size of the crystal grains and roughening of the electroplated coating surface. In particular: (1) when a ligninsulfonic acid or its salt having a weight-average molecular weight of lower than 1,000 is used, the improvement in the adhesion to the paint, particularly the secondary (water-resistant) adhesion, is insufficient, though the size of the crystal grains is reduced. When a ligninsulfonic acid or its salt having a weight-average molecular weight of higher than 100,000 is used, its solubility in the plating bath is poor and the improvement in the primary and secondary adhesions to the paint is insufficient.

(2) The degree of sulfonation is limited, since when it is less than 0.6 (for molecular weight of 500), the solubility in the plating bath is reduced and the amount thereof to be added to the plating bath is limited and, in addition, the reduction in size of the crystals and the complicated roughening of the surface become insufficient.

(3) The number of carboxyl groups is limited, since when the carboxyl groups in the ligninsulfonic acid or its salt is increased in number, the secondary (water-resistant) adhesion of the paint is deteriorated.

Anyway the present invention must be conducted on an industrial scale carefully, since the quality of the organic polymers (ligninsulfonic acids) vary with respect to the effects of the present invention depending on the production lot.

(A-10) polytannic acid sulfonates and polytannic acid derivative sulfonates;

(A-11) humic acid, nitrohumic acid, their derivatives and their salt sulfonates.

The water-soluble organic polymers usable in the present invention can be classified into the following groups c and d:

group C: anionic, cationic and amphoteric water-soluble organic polymers having a weight-average molecular weight of 1,000 to 1,000,000 and at least one aromatic ring and 1 to 10 hydroxyl groups (—OH) on average for a molecular weight unit of 500, and 0.1 to 4 sulfo groups (—$SO_3$) on average, for the molecular weight unit of 500 or 0.1 to 5 groups on average of at least one kind of polar groups selected from the group consisting of phosphoric acid groups

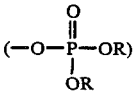

(R being a hydrogen atom or a hydrocarbon group; the same shall apply hereinafter), phosphorous acid groups 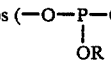 , phosphonic acid groups 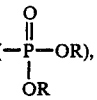 , phosphonous acid groups 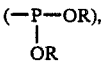 , phosphinic acid groups 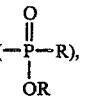 , phosphinous acid groups 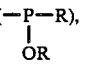 , tertiary amino groups 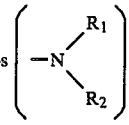 , quaternary ammonium bases 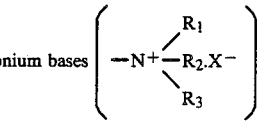

(in which $R_1$, $R_2$ and $R_3$ are the same of different and they each represent a straightchain or branched alkyl or hydroxyalkyl group or an aromatic group such as phenyl or benzyl group and X represents a counter anion) and carboxyl group (—COOH) as indispensable components, wherein the main chain bonding the aromatic rings together comprises at least one of C—C linkage C=C linkage and ether linkage (C—O—C); and group d: anionic, cationic and amphoteric water-soluble organic polymers having a weight-average molecular weight of 1,000 to 1,000,000, at least one aromatic ring having at least one hydroxyl group as a substituent for a molecular weight unit of 500 and 0.1 to 4 sulfo groups (—$SO_3$) on average for a molecular weight unit of 500 or 0.1 to 5 groups on average of at least one kind of polar groups selected from the group consisting of phosphoric acid groups

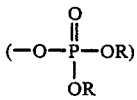

(R being a hydrogen atom or a hydrocarbon group; the same shall apply hereinafter), phosphorous acid groups ($-O-\underset{\underset{OR}{|}}{P}-OR$), phosphonic acid groups ($-\overset{\overset{O}{\|}}{\underset{\underset{OR}{|}}{P}}-OR$), phosphonous acid groups ($-\underset{\underset{OR}{|}}{P}-OR$), phosphinic acid groups ($-\overset{\overset{O}{\|}}{\underset{\underset{OR}{|}}{P}}-R$), phosphinous acid groups ($-\underset{\underset{OR}{|}}{P}-R$), tertiary amino groups $\left(-N\begin{matrix}R_1\\R_2\end{matrix}\right)$, quaternary ammonium bases $\left(-N^{+}\begin{matrix}R_1\\-R_2.X^{-}\\R_3\end{matrix}\right)$ (in which $R_1$, $R_2$ and $R_3$ are the same or different and they each represent a straight-chain or branched alkyl or hydroxyalkyl group or an aromatic group such as phenyl or benzyl group and X represents a counter anion) and carboxyl group (—COOH) as indispensable components, wherein the main chain bonding the aromatic rings together comprises at least one of C—C linkage, C=C linkage and ether linkage (C—O—C).

The water-soluble organic polymers in the groups c and d may contain halogen atoms such as Cl and Br and functional groups such as nitrile, nitro and ester groups in addition to the above-mentioned polar groups in the side chains.

Examples of the water-soluble organic polymers of the groups c and d which satisfy the conditions of the present invention include the following polymers (B-1) to (B-4):

(B-1) water-soluble anionic and amphoteric organic polymers comprising any of the above-mentioned water-soluble organic polymers (A-1) to (A-11) as the matrix and at least one polar group selected from the following group (I) introduced therein: polar groups in group (I): tertiary amino groups, quaternary ammonium bases, carboxyl group, phosphoric acid groups, phosphorous acid groups, phosphonic acid groups, phosphonous acid groups, phosphinic acid groups and phosphinous acid groups;

water-soluble anionic, cationic and amphoteric organic polymers comprising any of the above-mentioned organic polymers A-1, A-2, A-3, A-4, A-8, A-9, A-10 and A-11 but which are not sulfonated yet and at least one polar group selected from the above group (I) introduced therein;

products prepared by modifying formalin condensates corresponding to A-4, A-5, A-6 and A-7 but which are free of sulfo group. They include the following compounds:

A-4′: formalin condensates of phenol, phenolic carboxylic acid, alkylphenols and derivatives of them;

A-5′: formalin condensates of mono- and polyhydroxynaphthalenes and derivatives of them;

A-6′: formalin condensate of phenylphenol; and

A-7′: formalin condensate of dihydroxydiphenyls; water-soluble anionic, cationic and amphoteric organic polymers comprising any of the abovementioned polymers A-4′ to A-7′ and at least one polar group selected from those of the group (I);

(B-2) poly-p-vinylhydroxystyrene/maleic anhydride copolymers and aminated or phosphated products of them;

(B-3) sulfonated formalin condensates of phenylphosphonic acid (or its derivative) and phenol (or its derivative) or resorcinol (or its derivative) and salts thereof.

The phenylphosphonic acid derivatives include monooctyl phenylphosphonate, diphenylphosphonic acid, 0-methyl hydrogen phenylthiophosphonate and diphenylphosphinic acid.

The resorcinol derivatives include 2,6-dihydroxyacetophenone, 2,4-dihydroxyacetophenone, resorcinol monomethyl ether, resorcinol monohydroxyethyl ether, 2-methylresorcinol, 7-hydroxy-4-methylcoumarin and 2-ethylresorcinol.

The phenol derivatives include all of the phenols, phenolic carboxylic acids and alkylphenols described in the above item (A-4).

(B-4) humic acid, nitrohumic acid, their salts and aminated products of them.

The compounds of the above groups A and B can be used either alone or in the form of a mixture of two or more of them. The salts of the organic polymers are not limited and they include, for example, Na, Ca and $NH_4$ salts.

The weight-average molecular weight of the water-soluble organic polymers usable.in the present invention is limited to 1,000 to 1,000,000, preferably 1,000 to 500,000 and most preferably 2,000 to 100,000, since the molecular weight of them exerts an influence on the effects of the present invention. In particular, when the molecular weight is lower than 1,000, no significant paint adhesion effect can be obtained and when it exceeds 1,000,000, the solubility of the organic polymer in the plating bath is poor, the effects of the present invention cannot be obtained and the concentration thereof in the plating bath is limited to cause problems. Thus, in view of the solubility in the plating bath and easiness of the exhibition of the functions such as adhesion to the paint, the most preferred weight-average molecular weight is in the range of 2,000 to 1,000,000.

The polar groups such as a sulfo group or a phosphoric acid group (excluding a hydroxyl group and aromatic rings) are important particularly for the dissolution of the organic polymer in the plating bath, reduction of the diameter of the crystal grains and roughening of the surface. The polar group density is preferably in the range of 0.1 to 4 sulfo groups on average and 0.1 to 5, more preferably 1 to 3 polar groups other than a sulfo group for a molecular weight unit of 500. When the polar group density is less than 0.1, the solubility in the plating bath is poor and poses problems. When the number or sulfo groups exceeds 4 or when that of other polar groups exceeds 5, the corrosion resistance of the electroplated coating thus obtained is reduced to pose problems. Among the polar groups, a sulfo group is most preferred, since the organic polymers having the sulfo group exhibit the most excellent adhesion to paints. The hydroxyl group and aromatic ring are indispensable constituents of the organic polymers in the present invention from the viewpoint of an improvement in the adhesion to paints and corrosion resistance after the painting. The number of them contained inthe molecule are an important factor. The larger the number the hydroxyl groups for a molecular weight unit of 500, the better (the upper limit of the number being 10). The number of the aromatic rings is preferably at least 2. It is preferred for exhibiting the effects that the hydroxyl groups are bonded directly to the aromatic rings. The main chain bonding the aromatic rings together comprises preferably C—O—C and most preferably hetero atom-free C—C or C=C. It is not preferred in the present invention that the main chain contain an ester bond (OCO) or amide bond ($CONH_2$), since the secondary (water resistant) adhesion to the paint is not improved in such a case. Supposedly, when the main chain is such an undesirable one, the bond is unstable because of decomposition or modification in the steps of the electrolysis and baking of the paint or hydrolysis owing to a pH elevation to 12 or higher caused when the layer below the coating film is corroded. The factors such as the molecular weight of the water-soluble organic polymer, constituting units, kind and density of the polar group and kind of the main chain are essentially quite important in the electroplated coating and the process for the preparation thereof according to the present invention.

The fundamental zinc electroplating baths usable in the present invention are known ones containing 10 to 600 g/l of zinc ion such as (1) known acidic baths such as a sulfate bath containing zinc sulfate, a chloride bath containing zinc chloride, a borofluoride bath and mixture of them, (2) neutral baths vatted by neutralization of zinc chloride with ammonia, and (3) zinc pyrophosphate bath containing zinc pyrophosphate and zincate bath containing zinc and sodium hydroxide and (4) zinc cyanide plating bath. Among them, the baths (1) are preferred.

Further, the fundamental zinc electroplating baths usable in the present invention include known or new zinc alloy plating baths comprising the above-mentioned zinc plating baths (1) to (4) which further contain 1 to 600 g/l of compound(s) selected from the group consisting of chlorides, sulfates, fluorides, cyanides, oxides, organic acid salts and phosphates of alloy elements such as iron, nickel, chromium, cobalt, manganese, copper, tin, lead, magnesium and aluminum of these metals in the form of simple substances. Among them, plating baths prepared from the baths (1) are preferred.

The amount of the water-soluble organic polymer to be added to the plating bath is in the range of 2 to 200 g/l, preferably 3 to 100 g/l and most preferably 5 to 50 g/l for the following reasons: although the diameter of the plated crystal grains can be reduced and the electroplated coating surface can be roughened to some extent with less than 2 g/l of the polymer, the chemical properties such as the primary and secondary adhesions to the paint, (i.e. bonding properties) of the coating surface can not be sufficiently improved in such a case. On the contrary, when it exceeds 200 g/l, the electroplated coating becomes brittle to pose problems in the press working step. To provide well-balanced functions including the primary adhesion and secondary (water resistant) adhesion to the paint, corrosion resistance before and after the painting and workability, the amount of the polymer is preferably 3 to 100 g/l and most preferably 5 to 50 g/l. With such an amount of the polymer, the above-mentioned well-balanced functions are provided under electroplating conditions over wide ranges.

The plating bath used in the present invention is the most simple one containing necessary amounts of the metal ion(s), a buffering agent and a pH adjusting agent. The present invention is characterized in that its object can be attained sufficienlly by adding one or more of the above-specified water-soluble organic polymers to the bath. Essentially the addition of other assistants to the plating bath is unnecessary. On the contrary, the essential functions of the plated coating of the present invention are seriously deteriorated by many organic compounds and organic polymers used as assistants such as rust-proofing agent, brightener, pitting inhibitor, misting inhibitor and antifoaming agent, e.g. α-naphthalenesulfonic acid, isooctyl polyoxyethylene ethers, gelatin, coumarin and propargyl alcohol. Therefore, when they are to be used, religious care must be taken of their amount, etc.

The plating bath of the present invention in which the organic polymer is stably dissolved does not necessitate stirring for obtaining a homogeneous dispersion after the preparation thereof and the scaling enlargement is easy. The pH of the plating bath and the metal ion concentration must be controlled carefully so as not to reduce the solubility of the water-soluble organic polymer used.

Preferred plating conditions comprise a current density of 1 to 400 $A/dm^2$ and a bath temperature of 1° to 80° C. Though the pH of the plating bath can range from 1 to 12, an acidic pH is preferred. Although the electrolytic current is preferably a direct crrrent, it is possible to use also pulse current or a current having a special waveform. It is important to stir the plating bath when a high-speed plating is conducted. In the. high-speed continuous plating of a steel strip, the relative stirring rate (sheet to the plating bath) is desirably about 90 to 120 m/min.

In the invention, the process for proparing an electroplated coating of a composite of zinc and an organic polymer is characterized in that the composite polymer/metal codeposit is formed on the molecular level, since the water-soluble polymer is used. The present invention is utterly different in this point from ordinary dispersion plating processes wherein water-insoluble grains are codeposited by macroscopic dispersion or composite formation. It is possible to combine the process of the present invention with the conventional dispersion plating process.

The amount of the water-soluble organic polymer in the plated coating is in the range of 0.1 to 30 wt. %, preferably 0.2 to 15 wt. %, based on the total plated coating. When the amount of the organic polymer codeposited is insufficient, the quality of the plated coating is close to that of a simple zinc coating and, therefore, the intended effect of adhesion to the paint and rust-proofing effect cannot be provided sufficiently. On the contrary, when the amount is excess, the plated coating becomes brittle and, therefore, the press workability is deteriorated to pose problems. From the viewpoint of the balance of the functiohs such as the adhesion to the paint, corrosion resistance and press workability, the amount of the codeposited organic polymer is preferably in the range of 0.2 to 15 wt. %, and most preferably 0.5 to 5 wt. %.

The amount of the codeposited water-soluble organic polymer varies mainly depending on the polymer concentration, current density, manner of stirring and electric charge of the organic polymer. It is increased by increasing the polymer concentration, current density and stirring strength. When the molecular skeletons are substantiall the same, the amount of the codeposit is in the following order: cationic polymer>amphoteric polymer>anionic polymer. Thus, the amount of the organic polymer codeposited in the plated coating is controlled by suitably selecting the above-mentioned factors. The control is considerably easy.

The second object of the present invention is to improve mainly the adhesion to the paint and corrosion resistance by controlling the diameter and shape of the plated crystal grains by the effect of the water-soluble organic polymer. Namely, the present invention aims at increasing the available adhesion surface area by reducing the crystal grain size (which does not mean the smoothing as well as providing an anchor effect by accelerating the roughening of the surface. This object can be attained by the following two approaches: one of them comprises further reducing the diameter of the crystal grains to increase the available adhesion surface area (see FIG. 2). The other approach comprises controlling the crystal growth in a given direction to form, for example, flaky crystals and to form a plated coating in which the flaky crystals are complicatedly entangled to form a plated coating having a three-dimensional structure so that a surface morphology suitable for exhibiting the anchor effect is provided while the crystal size is not particularly reduced (see FIG. 1). As a matter of course, these two approaches can be combined together. When the surface morphology is made complicated to provide the anchor effect while the crystals are coarse, the secondary (water resistant) adhesion and corrosion resistance are inferior to those provided when the diameter of the crystal grains is reduced, though the primary adhesion in the former is superior to that in the latter. This phenomenon occurs supposedly because the electroplated coating is not dense.

The crystal grain size in the electroplated coating of the present invention is preferably in the range of 10μ to 50 Å. The term "crystal grain size" herein refers to an average of two larger values of the length among the three lengths in the x, y and z-axes. The relationship between the crystal grain diameter and the adhesion to the paint is as follows: when the diameter of the crystal grains in the electroplated coating is about 10 to 2μ, excellent adhesion to the paint cannot be provided unless the surface morphology is complicated to an extent capable of expecting the anchor effect. When the crystal grain diameter is less than 2μ, the effect of the adhesion to the paint is exhibited even when the surface is not a three-dimensionally complicated one. The effect is remarkable when the crystal grain diameter is less than 5,000 Å and the most excellent adhesion to the paint is obtained when it is in the range of 1,000 to 50 Å. Supposedly this phenomenon occurs because the effect of increasing the available adhesion surface area is remarkable when the crystal grain diameter is less than 5,000 Å, patricularly less than 1,000 Å.

However, the secondary (water resistant) adhesion to the paint is not always ensured by the physical effect provided by reducing the crystal grain diameter and complication of the morphology of the plated coating surface (anchor effect), though these effects are quite sufficient for the primary adhesion to the paint. This is because the plated coating is dissolved and the chemical bonds in the paint film are broken by an alkali formed beneath the paint film in a humid atmosphere. Therefore, to ensure the functions including the secondary adhesion and corrosion resistance, it is necessary to make the electroplated coating resistant to an alkali or to improve the chemical properties of the coating. Thus it is important to form a molecular composite comprising a water-soluble organic polymer in a plating matrix from this viewpoint. The electroplated coating surface having only a low solubility in an alkali can be provided by the composite electroplated coating comprising the specified water-soluble organic polymer of the present invention.

The composite electroplated coating formed in virtue of the effects provided by controlling the crystal grain diameter and crystal shape and the formation of the composite electroplated coating comprising the water-soluble organic polymer has excellent adhesion to the paint, corrosion resistance before and after the painting, weldability and press workability. Particularly the electroplated coating of the present invention has a high affinity for the paint due to the composite formation of the water-soluble organic polymer. Accordingly, the pretreatment of the substrate such as a chemical treatment with, e.g., a phosphate or chromate, or blasting treatment which is indispensable in the conventional processes is utterly unnecessary in the present invention. This is a great feature of the electroplated metallic material of the present invention. The adhesion to the paint and corrosion resistance after coating provided by the present invention without any pretreatment are superior to those provided by the conventional process which necessitates the pretreatment of the substrate.

In an evaluation test, a steel sheet electroplated with the composite coating according to the present invention is coated directly, without any pretreatment, with a cationic electrodeposition paint comprising an epoxy resin to form a paint film having a thickness of 30μ or with a baking powdery polyester paint to form a paint film having a thickness of 40μ and then it is baked. A columnar jig is bonded to the paint film surface with Araldite. The metallic material thus prepared exhibits a primary adhesive power of the paint film of at least 100 to 150 kg/cm$^2$ easily in a vertical tensile test (Pull Gauge 1000 M; a product of Motofuji Co., Ltd.). When the paint is directly applied to an ordinary electroplated zinc or zinc alloy coating, an adhesive power thereof to the paint is less than about 20 to 30 kg/cm$^2$. In a cross-cut adhesion test, an Erichsen sampling test and a cellophane tape peeling test, the products of the present invention get full marks (100/100) and no peeling is caused at all even with an 8-mm extrudate. When a chemical treatment with a phosphate or chromate is conducted before the painting, the adhesive power to the paint is of the order of about 20 to 30 kg/cm$^2$. The second (water-resistant) adhesion is evaluated by immersion in ion-exchanged water having a specific resistance of at least 50 at 40 to 60° C followed by a cross-cut adhesion test and a cellophane tape peeling test to reveal that the product of the present invention gets full marks (100/100) easily after immersion for 100 days, while an ordinary product prepared by directly painting the electroplated zinc or zinc alloy coating gets marks of less than 50/100 after immersion for 10 to 60 days. Ordinary electroplated metallic materials do not exhibit such an excellent secondary (water-resistant) adhesion even after the chemical treatment.

According to the present invention, excellent functions such as adhesion to the paint and corrosion resistance after the painting can be obtained by combining the conventional dispersion plating bath containing ceramic grains or water-insoluble polymer with the water-soluble organic polymer of the present invention. The conventional electroplated coatings formed by using the dispersion plating bath have serious defects for the use as the surface of the substrate to be painted, i.e. insufficient adhesion to the paint [particularly the secondary (water-resistant) adhesion] and corrosion resistance after painting, though they have an improved corrosion resistance. The combination of the conventional dispersion-plated coating with the coating of the present invention is quite suitable for plating small metallic materials, while some problems remain when it is employed in the continuous plating of steel strips, etc.

The ceramics usable in the present invention are known ones including, for example:

oxides: $Al_2O_3$, $SiO_2$, $TiO_2$, $ZrO_2$, $Y_2O_3$, $ThO_2$, $CeO_2$, $Fe_2O_3$, kaolin, BeO, $Eu_2O_3$ and $BaCrO_4$, carbides: $B_4C$, $Cr_3C_2$, SiC, WC, diamond (C), ZrC, TiC, graphite and graphite fluoride, nitrides: BN, $Si_3N_4$ and TiN, borides: $Cr_3B_2$ and $ZrB_2$, sulfides: $MoS_2$, $WS_2$ and CdS, and silicates: $2MgO.SiO_2$, $MgO.SiO_2$ and $ZrO_2.SiO_2$.

The water-insoluble polymers usable in the present invention include known ones including, for example, polyvinyl chloride, polyethylene, acrylonitrile/-butadiene/styrene resin, epoxy resin, polyester, polyamide, polyimide, polybutadiene, urea/formaldehyde resin, acrylic resin, polystyrene, polypropylene, polyisoprene, polyurethane, polycarbonate, polyurea, alkyd resin, melamine resin, phenolic resin and tetrafluoroethylene resin.

They can be used either alone or in the form of a mixture of two or more of them. The amount of the particles to incorporate in the plating bath is desirably in the range of 5 to 500 g per liter of the bath. The smaller the grains, the better the dispersion stability. Therefore, ultrafine grains of smaller than 1$\mu$, preferably smaller than 0.1$\mu$ are preferred. The amount of the ceramic grains or water-insoluble organic polymer to be incorporated in the plating matrix to form the composite is preferably in the range of 1 to 30 vol. % based on the total cedeposit. When the amount of the codeposited grains is insufficient, no effects of the composite formation can be exhibited and, on the other hand, when it exceeds 30 vol. %, the plated coating becomes brittle or the adhesion thereof to the substrate is reduced to pose problems. The most preferred amount ranges from 2 to 15 vol. %. The amount of the code-posited water-soluble organic polymer is in the range of 0.1 to 30 wt. %, preferably 0.2 to 15 wt. %, based on the total codeposit. The water-soluble organic polymer acts also as a dispersant for the ceramic and the water-insoluble organic polymer grains.

The metallic materials to be electroplated in the present invention are not particularly limited. They include, for example, steel, copper, lead, brass and aluminum.

The composite plating bath according to the present invention is prepared on the assumption that the electroplated coating thus formed is further directly painted so as to further improve the corrosion resistance and to provide a beautiful appearance of the metallic material. Therefore, the adhesion to the paint is an indispensable function required of the composite organic polymer-/electroplated zinc coating.

It is also possible to use a metallic material the surface of which has already been electroplated or hot-dipped as the material to be electroplated to form multiple electroplated coatings. This process is included in conventional processes for hybridization with a substantially organic polymer-free electroplated coating or hot-dipped coating. Namely, the metallic material having the multiple plated coatings thus formed thereon is formed so as to overcome a defect of the ordinary electroplated coatings (i.e. insufficiency of the adhesive power to the paint) by forming the composite of zinc and the organic polymer of the invention on the ordinary electroplated or hot-dipped coating while the features of the latter coating are maintained.

The metallic materials to be used in forming the undercoat are not particularly limited. The materilas usable in the electroplating include zinc, zinc alloys, tin, nickel, chromium, lead, lead alloys and a composite metal containing inorganic grains or a water-insoluble resin. The materials usable in the hot dipping include, for example, zinc, zinc alloy and aluminum. Though the features of the upper composite organic polymer coating can be exhibited sufficiently when the thickness of the coating is about 0.1 or mcre, the higher limit of the thickness is not provided.

The metallic material having the multiple plated coatings formed thereon can be produced easily by replacing the last cell in plating steps with the composite organic polymer plating cell. Subsequent undercoating lines such as a phosphate or chromate treatment line is unnecessary.

Water-soluble organic compounds have been used in the electroplating from old times. Namely, a surfactant having a relatively low molecular weight is added in only a very small amount (0.001 to 0.05%) as an assistant (brightener) to the plating bath mainly in order to improve the decorative effect. The water-soluble organic compounds are used also as misting inhibitor, impurity remover (complexing agent), defoaming agent, insoluble suspending agent or coagulative precipitating agent for impurities, or as dispersant for codeposited grains in the dispersion plating process. Therefore, in the conventional processes, the water-soluble organic polymer used as the assistant cannot improve the adhesion to the paint or corrosion resistance but rather it frequently deteriorates these properties unlike in the present invention. The amount and concentration of such a surfactant is minimized in the prior art, since it is recognized generally that the surfactant deteriorates the physical properties (toughness, corrosion resistance, etc.) of the plated coating. Thus, the organic compounds and some organic polymers such as gelatin, saccharin or molasses positively added heretofore to the plating bath and thereby incorporated in the electroplated coating exhibited no remarkable merit other than the brightening effect due to their chemical structures. In the present invention, they are used mainly for improving the adhesion to paint and corrosion resistance utterly unlike in the conventional processes. Accordingly, the manner of using them is different from that in the conventional processes. For example, the object of the present invention can be sufficiently attained by using only one kind of the water-soluble polymer, while three components (the first brightener to the third one) are usually necessitated for exhibiting the brightening effect in the prior art. The above-mentioned functions are exhibited according to the present invention wherein the electroplating metal is positively codeposited with the water-soluble organic polymer having a new, specified chemical structure to form a composite.

The composite plated coating of the present invention can be directly painted without necessitating any ordinary pretreatment such as phosphate treatment, chromate treatment or blasting treatment. Therefore, the present invention is free from various problems such as environmental pollution and complicated schedule control posed in the pretreatment and, in addition, the labor and energy can be saved.

The painting can be conducted by a known method such as electrodeposition, electrostatic spray coating, spray coating and roll coating. The paints usable herein include thermosetting paints, cold drying paints, ultraviolet (U.V.) curing paints and electron beam (E.B.) curing paints.

[Function]

The composite electroplated coating of the present invention has the following characteristic effects (1) to (5):

(1) The affinity for and bondability (via, e.g., a hydrogen bond or a chelate bond) to the paint are increased by the effect of the water-soluble organic polymer in the composite of the molecular level microscopically formed in the electroplated coating. As a result, quite excellent adhesion to the paint and the secondary (water-resistant) adhesion are exhibited.

(2) The corrosion resistance is increased by an insulating or rust-proofing effect of the water-soluble organic polymer codeposited in the electroplated coating, namely, crystal grains and grain boundaries in the coating.

(3) The available surface area is increased and the anchor effect is provided by reduction in the crystal size and roughening of the surface of the plated coating to improve the adhesion to the paint, and a dense coating is provided by the reduction in the crystal size to improve the corrosion resistance.

(4) The adhesion to the paint and corrosion resistance of the electroplated coating are further improved by the synergism of the above-described effects (1) and (2).

(5) The defects of the dispersion-plated coatings, such as poor corrosion resistance after painting and adhesion to the paint, can be overcome by using the water-soluble organic polymer of the present invention to form the composite with the dispersion plated coating comprising the ceramic particles or water-insoluble organic polymer.

In the process of the present invention for preparing the composite electroplated coating, the amount of the water-soluble organic polymer codeposited in the plating matrix varies depending on the molecular weight and fundamental skeleton of the water-soluble organic polymer incorporated in the plating bath, kind and density of the polar group, concentration of this polymer and electrolysis conditions. The diameter and shape of the crystal grains can be controlled. Particularly the molecular weight and the kind and density of the polar group exert a great influence on the diameter and shape of the crystal grain.

BRIEF DESCRIPTION OF DRAWINGS

FIG. 1(*a*) is that of No. 13 in Table 4 and FIG. 1(*b*) is that of No. 21 in Table 4. FIG. 2(*c*) is an electron photomicrogaphs of a crosssection of the electroplated coating shown in FIG. 2(*b*). FIG. 3(*a*) is that of the coating shown in FIG. 2(*a*) and FIG. 3(*b* ) is that of the coating shown in FIG. 2(*b*). FIG. 3(*c*) shows an enlarged part of FIG. 3(*b*). FIG. 4(*a*) is that of a pure Zn-Ni alloy coating (No. 65 in Table 4 and FIG. 4(*b*) is that of a composite coating of the organic polymer and Zn-Ni alloy (No. 27 in Table 4). FIG. 5(*a*) is that of No. 6 in Table 4 and FIG. 5(*b*) is that of No. 12 in Table 4. FIGS. 6 and 7 are diffraction patterns obtained by energy dispersion type X-ray spectrometry (UTW) and electron energy loss spectrometry (EELS), respectively. FIG. 6 shows the presence of C in each grain and FIG. 7 shows the state of C present between the grains.

[Examples]

Figure 1A:
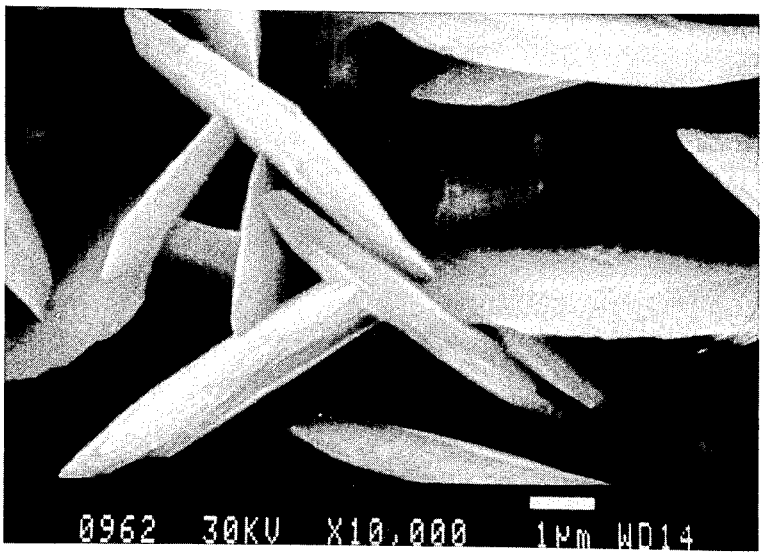
FIGS. 1 are electron photomicrographs of the surfaces of composite coatings of the water-soluble organic polymer prepared according to the present invention.

The following examples will further illustrate the present invention.

EXAMPLE 1

(1) Electroplating method

Pretreatment: A cold-rolled steel sheet was subjected to an alkali electrolysis, degreased, washed with water and electroplated under the following conditions:

Plating bath: The compositions of the fundamental plating baths used are shown in Table 1. The kinds of the water-soluble polymers are shown in Table 2. The kinds of the ceramic particles water-insoluble polymers are shown in Table 3. The compositions of the composite organic polymer plating baths and dispersion plating baths comprising a combination of them are shown in Tables 4, 5 and 6.

Plating conditions: The plating was conducted under the conditions comprising a direct current having 2 and a bath temperature a density of 4 to 200 A/dm$^2$ in the range of 30° to 60° C. The thickness of the electroplated coatings was 3$\mu$ in all the cases. The thickness was determined with the electromagnetic coating thickness gauge (SL-2L-SM; a product of Sanko Denshi Co., Ltd.)

The steel sheets electroplated with Ni or Cr and hot-dipped steel sheets in the following examples for the preparation of metallic materials having multilayer deposits were those available on the market.

(2) Painting method

The paint coatings shown in Tables 4 and 5 were prepared by directly electrodepositing a cationic epoxy electrodeposition paint (Elecron 9210; a product of Kansai Paint Co., Ltd.) on the electroplated surface of a substrate (voltage; 250 V) in such a manner that the paint film thickness after baking at 180° C. for 25 min would be 30μ. The product was directly subjected to the adhesion test without forming any intermediate coating or finish coating.

The paint coatings shown in Table 6 were prepared by using a baking type powderly polyester paint (NPC(300), available from Nippon Paint Co., Ltd.) This paint was directly applied to the surface of the electroplated substrate by an electrostatic spray coating method and baked at 230° C. for 5 min to form a paint film having a thickness of 40μ.

In the comparative examples, the chemical treatment was conducted with zinc phosphate (Bonderite 3004; a product of Nihon Parkerizing Co., Ltd.) (phosphate treatment) or with (grano Din 92; a product of Nippon Paint Co., Ltd.) (chromate treatment).

(3) Evaluation of corrosion resistance

A 5% NaCl solution was sprayed onto the sample continuously for 2 weeks according to JIS 2371 with an aqueous salt solution spray tester (a product of Itabashi Rika Co., Ltd.)

(4) Weldability

An electric spot welder (a product of Matsushita Sangyo KiKi K.K.) was used. The current density was 7,000 to 12,000 A.

(5) Press workability

An Erichsen extrusion tester, a four-way deformation tester (a product of Mashiko Seisaku-sho) and a bending tester were used.

(6) Results

Figure 1B:
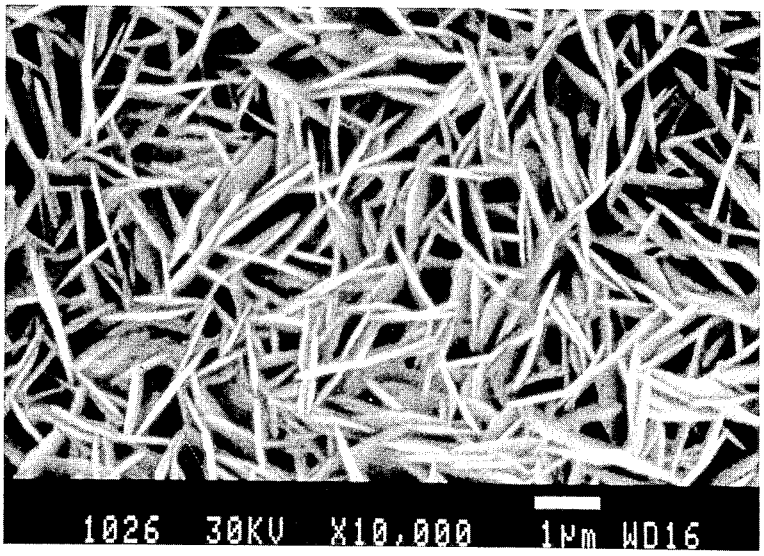

FIGS. 1(*a*) and 1(*b*) are electron photomicrographs of the surfaces of the invention composite coatings of the water-soluble organic polymer and zinc or an alloy of zinc (Nos. 13 and 21, respectively, in Table 4) taken with a scanning electron microscope SEM (JSM 880; a product of JEOL, Ltd.). The crystal grains in FIGS. 1(*a*) and 1(*b*) are flaky ones having relatively large diameters of about 3.6μ and 0.8μ and they are oriented to form a complicated three-dimensional structure. When the electroplated coating having such a surface roughness is painted, the anchor effect (fastening effect) is provided to improve at least the primary adhesion of the paint.

Figure 2A:
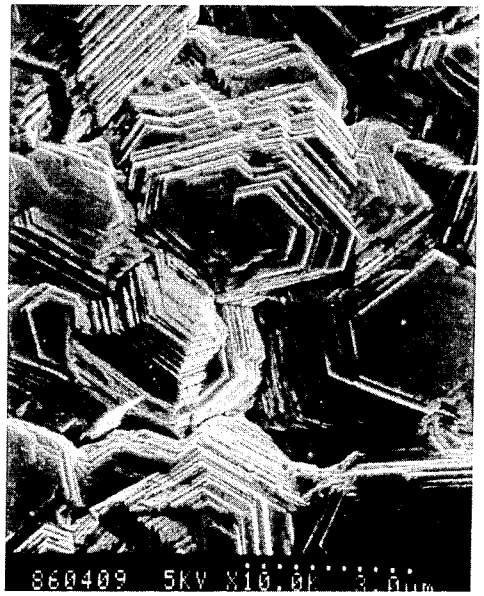
FIGS. 2(*a*) and 2(*b*) are electron photomicrographs of the crystal surfaces in the comparative electroplated pure zinc coating (No. 62 in Table 4) and electroplated coating of the present invention (No. 6 in Table 4), respectively.
Figure 2B:
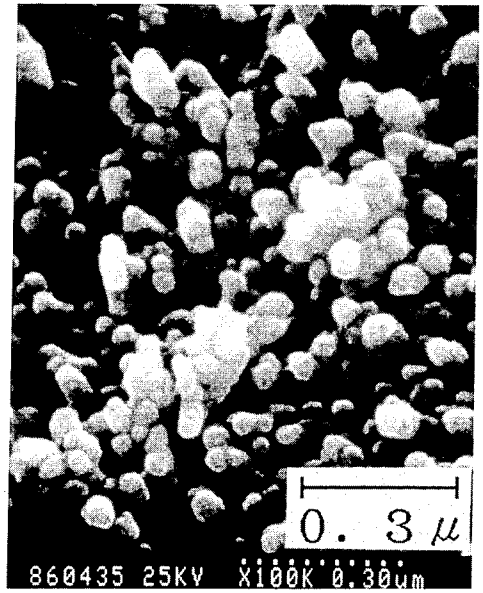
Figure 2C:
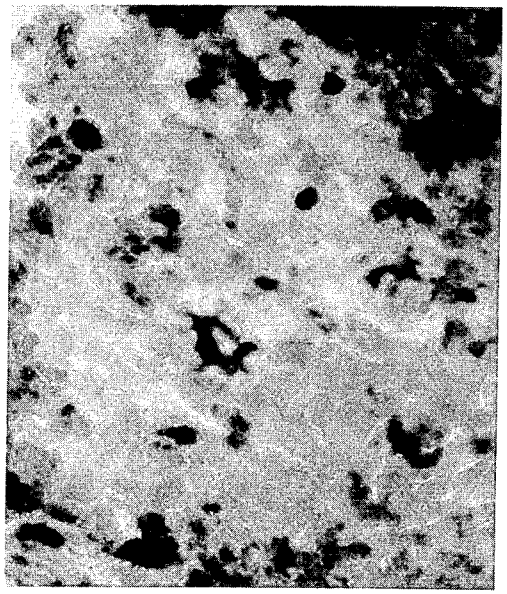

FIG. 2(*b*) is an electron photomicrograph of the surface of the composite coating with the water-soluble organic polymer of the present invention (No. 6 in Table 4) taken with a scanning electron microscope (S-800; a product of Hitachi, Ltd.) (Pt coating). FIG. 2(*a*) is an electron photomicrograph of a comparative pure zinc-plated coating surface (Comparative No. 62 in Table 4). It is apparent from these pictures that the crystal grain diameter is remarkably reduced to 300 to 600 Å in the composite coating, in FIG. 2(*b*), and nearly spherical crystals are aggregated, as recognized by electron diffractometry, while the crystals in FIG. 2(*a* are hexagonal plate-like ones having a size of several microns.

FIG. 2(*c*) is a crosssection of the electroplated coating shown in FIG. 2(*b*). This sample was prepared by cutting into ultrathin test pieces having a thickness of about 300 Å and the picture was taken with an analytical transmission electron microscope of the recent model (2000-FX, available from JEOL, Ltd. It is apparent also from the crosssectional photograph that the diameter of the crystal grains was reduced to 300 to 600 Å. The smaller the crystal grain diameter, the stronger the primary and secondary adhesions to the paint. In particular, particle grain diameter of smaller than 1000 Å is preferred.

Figure 3A:
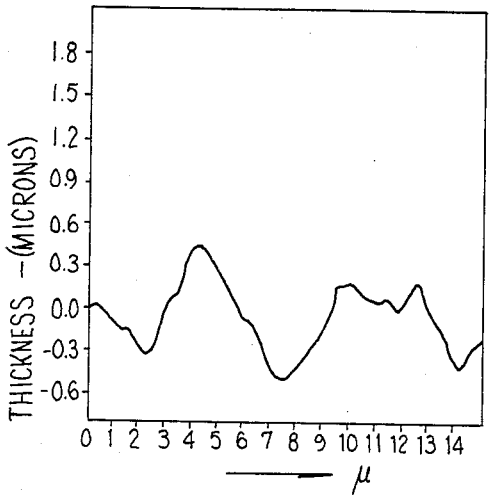
FIGS. 3 are graphs showing sectional profiles of the electroplated surfaces.
Figure 3B:
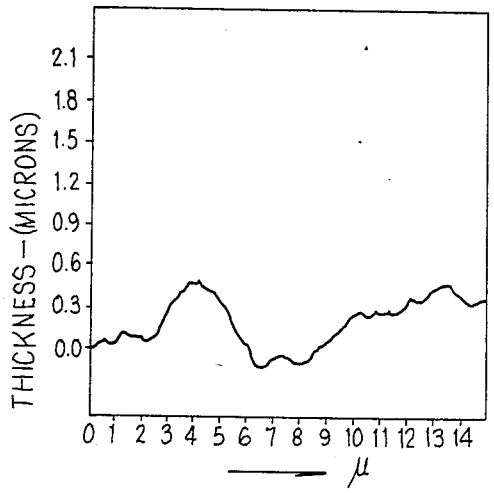
Figure 3C:
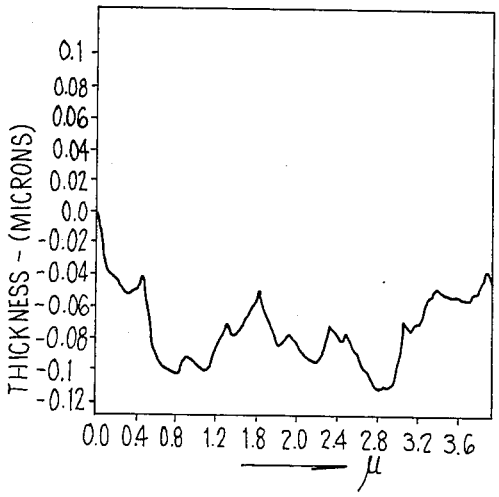
Figure 4A:
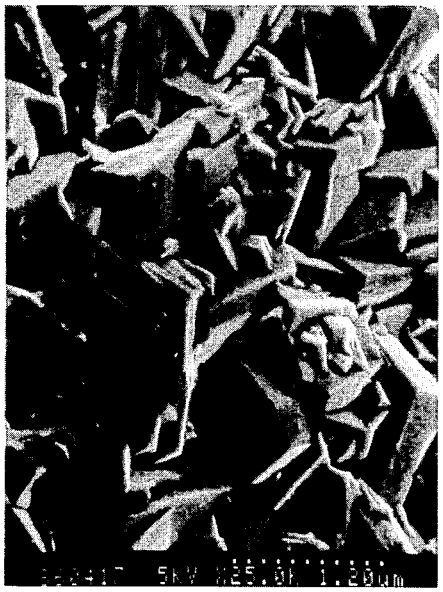
FIGS. 4 are electron photomicrographs of the crystal surfaces of electroplated alloy coatings.
Figure 4B:
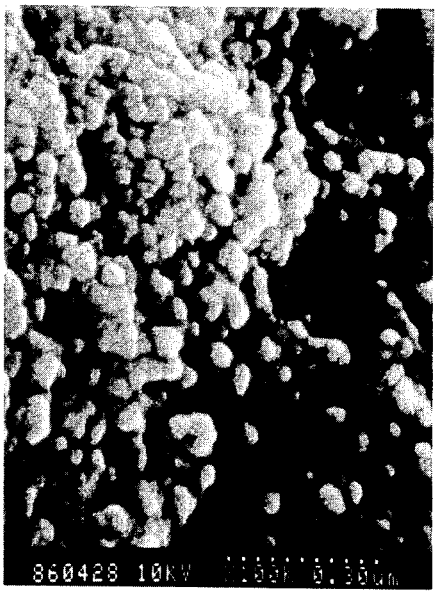

FIGS. 3 show the profiles of the surface roughness of the electroplated coating determined with SEM (ESA 3000 available from Elionix) provided with a sectional form observation device. FIG. 3(*a*) is a sectional profile of the surface of the pure zinc plated coating shown in FIG. 2(*a*) and FIGS. 3(*b*) and 3(*c*) are sectional profiles of the surface of the composite electroplated coating shown in FIG. 2(*b*). It is apparent from FIGS. 3 that the electroplated coating comprising the crystal grains the diameter of which was remarkably reduced by the composite water-soluble organic polymer [FIG. 2(*b*)] maintains the large roughness (undulation) of the pure plated zinc coating [FIG. 2(*a*)] urface and also small roughness (undulation) due to the reduced crystal particle size. FIG. 3(*c*) is an enlarged part of FIG. 3(*b*). An ultrafine roughness which cannot be recognized in FIG. 3(*b*) can be clearly recognized. Even if FIG. 3(*a*) is enlarged, such an ultrafine roughness cannot be recognized. Thus it is clear that by forming the composite with the water-soluble organic polymer, the roughness of the surface morphology is increased. Namely, the surface has complicated multiple undulations comprising both large and very small undulations overlapping each other to remarkably increase the available adhesion surface area. Thus, the anchor effect is expectable. The reduction in size of the crystal grains and roughening of the electroplated coating surface are recognized also in electroplated alloy coatings. This fact, is shown in FIGS. 4. FIG. 4(*a*) is an electron photomicrograph of the surface of an electroplated pure Zn-Ni alloy coating (No. 65 in Table 4) and FIG. 4(*b*) is that of the surface of the composite coating (No. 27 in Table 4).

Figure 5A:
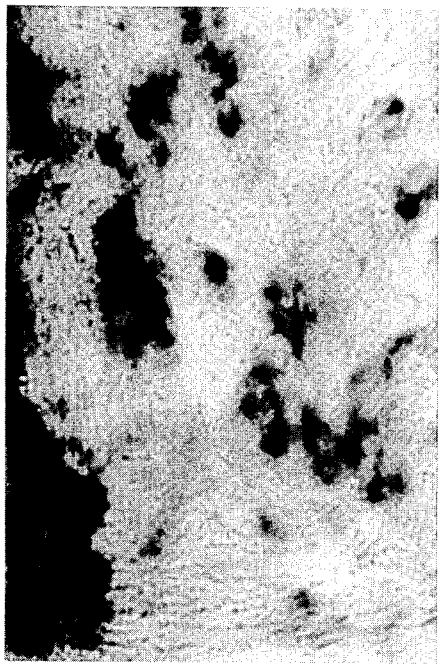
FIGS. 5 are electron photomicrographs showing the state of the organic polymer codeposit observed by the phase contrast method.
Figure 5B:
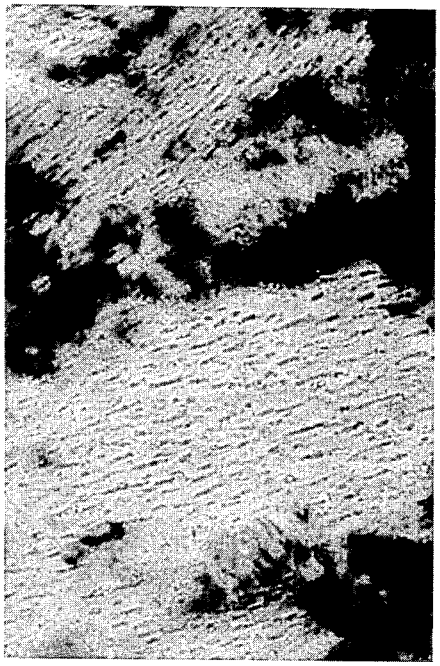

FIGS. 5 show the state of the organic polymer codeposit observed by the phase contrast method with a transmission electron microscope. In this method, the presence of the organic polymer is represented by black spots when a slight over-focus is provided in the focusing step, since the electron transmission rate of the metal in the electroplated coating is different from that of the organic polymer. FIG. 5(*a*) shows the state of the codeposit of the same sample as in FIG. 2(*b*) cut into pieces of about 300 Å, observed by the phase contrast method (+1800 Å overfocus). The black spots are dispersed uniformly to reveal that the molecular composite of the organic polymer in the metallic matrix was formed. Such black points are not observed in the electroplated pure zinc coating shown in FIG. 2(*a*). FIG. 5(*b*) shows the phase contrast image of the composite electroplated film (No. 12 in Table 4), wherein the black points are recognized more clearly.

FIGS. 6 and 7 show the results of an energy dispersion type X-ray spectrometry (EDX/UTW; Ultrathin Window Detector) and electron energy loss spectrometry (EELS) to examine whether C was present in each grain shown in FIG. 2(*c*). FIGS. 6 show the results of UTW and EELS conducted by applying a spot of electron beams (about 70 Å) to the grain and FIGS. 7 show the results of the same analyses as in FIGS. 6 except that the spot was applied to the grain boundary (not the overlapped part of the grains). FIGS. 6(*a*) and 7(*a*) show the results of UTW and FIGS. 6(*b*) and 7(*b*) show the results of EELS. FIGS. 6 and 7 suggest that C was detected in both of the crystal grain and crystal grain boundary. It is apparent from this fact that the organic polymer codeposit was present in both of the crystal grain and the boundary. However, cases in which C was unevenly distributed were observed depending on the kind of the water-soluble polymer. In the electroplated pure zinc coating or pure zinc alloy coating, C was not detected by any of UTW and EELS.

Table 4 shows the primary adhesion to the paint and corrosion resistance of each plated coating prepared by the process of the present invention for preparing the composite coating with the water-soluble organic polymer as compared with those of a comparative sample.

No significant difference could be recognized between the products of the present invention (Nos. 1 to 60) and comparative products (Nos. 61 to 90) in the results of cross-cut adhesion tests conducted for evaluating the adhesion to the coating film.

However, a remarkable difference lied between them in the results of Erichsen extrusion tests conducted under severe conditions for evaluating the adhesion to the paint film. In particular, it is apparent that the products of the present invention comprising the composite coating of the organic polymer and zinc (Nos. 1 to 60) had an adhesion to the paint film far superior to that of the organic polymer-free zinc alloy electroplated coatings (Nos. 61 to 70). Electroplated coatings prepared from plating baths containing a water-soluble organic polymer which does not satisfy the conditions of the present invention are shown as comparative products (Nos. 72 to 86). It will be understood that though the primary adhesive power to the paint of the electroplated coatings prepared from these baths was higher than that of the organic polymer-free electroplated pure zinc or zinc alloy coatings in some cases, the functions of them were far inferior to those of the products of the present invention. It will be understood also that the adhesion to the paint was not improved sufficiently in the composite electroplated coating (No. 71) prepared from a plating bath containing only an insufficient amount of the water-soluble organic polymer satisfying the conditions of the present invention, since the amount of the codeposit in the electroplated coating is insufficient. The effects of the present invention could not sufficiently be exhibited when a plating bath used (No. 78, 84 or 86) contained additives not satisfying the conditions of the present invention in addition to the water-soluble organic polymer satisfying the conditions of the present invention. Comparing the products of the present invention with electroplated steel sheets which were subjected to the chemical treatment (Nos. 87 to 90), the former had superior primary adhesion to the paint film except for comparative product No. 88 which had the primary adhesion equivalent to that of the present invention.

Comparing the products of the present invention (Nos. 1 to 60) with the organic polymer-free comparative products (Nos. 61 to 70), comparative products (Nos. 71 to 86) and comparative products each comprising a chemically treated steel sheet (Nos. 87 to 90) in the water-resistant adhesion tests, the function of the products of the present invention (Nos. 2 to 60) were superior to that of all of the comparative products except that the function of the product No. 1 of the present invention in which the amount of the codeposit was relatively small was equivalent to that of the comparative product Nos. 87 and 88.

From the above-described results, it can be understood that the primary and secondary adhesions of the electroplated zinc or zinc alloy coating surface to the paint are remarkably improved by code-positing a small amount of the water-soluble organic polymer with metallic zinc.

With respect to the corrosion resistance, the products of the present invention (Nos. 2 to 60) were far superior to that of all of the comparative products (Nos. 61 to 90) except that the function of the product No. 1 of the present invention was equivalent to that of the comparative product Nos. 89 and 90. It is apparent, therefore, that the composite electroplated coatings of the present invention have an effect of remarkably improving the corrosion resistance.

In the spot weldability tests of the products of the present invention, it was found that the possible number of spots therein by a continuous spot welding process was larger than that in an electroplated pure zinc or pure zinc alloy coating. Supposedly this is because the adhesion between the pole bolt and the electroplated coating surface (pickling phenomenon) is inhibited.

As for press workability, the products of the present invention exhibited excellent workability in all of Erichsen process, four-way deformation process and 1 mm-diameter bending process.

As described above, it has been found that the defects of ordinary electroplated zinc coatings can be overcome by using the water-soluble organic polymer having a specified chemical structure to form a composite and that electroplate coatings having excellent adhesion to the paint, corrosion resistance, weldability and press workability can be obtained from the plating bath of the present invention without necessitating the chemical treatment.

Table 5 shows the compositions of the composite multilayer metallic coating of the present invention and their adhesion to the paint and corrosion resistance as compared with those of comparative products. It will be understood that both adhesion to the paint and corrosion resistance are remarkably improved by forming the composite coating of the organic polymer on an electroplated pure zinc monolayer coating as compared with those of the same, but chemically treated, coating. These results suggest that the characteristic functions of the present invention such as adhesion to the paint and corrosion resistance can be imparted to the surface layer while the physical properties of the electroplated under coat are maintained.

Table 6 shows the compositions of the composite dispersion-electroplated metallic materials and their adhesion to the paint and corrosion resistance in comparison with those of the comparative products. It will be understood that by forming the composite of the water-soluble organic polymer having the specified chemical structure according to the present invention (Nos. 104 to 115), the primary and secondary adhesions to the paint and corrosion resistance after painting of the ordinary dispersion-electroplated coatings (comparative product Nos. 116 to 118) are remarkably improved. Thus, the defects of the dispersion-electroplated coatings (poor adhesion to the paint and corrosion resistance after painting) can be overcome according to the present invention.

TABLE 1

| Plating bath | Symbol | Composition of plating bath | |
|---|---|---|---|
| Zn | A | $ZnSO_4.7H_2O$ | 240 g/l |
| | | $NH_4Cl$ | 15 g/l |
| | | $Al_2(SO_4)_3.18H_2O$ | 30 g/l |
| | | $CH_3COONa$ | 15 g/l |
| | | pH 3~5 | |
| | B | $ZnSO_4.7H_2O$ | 200 g/l |
| | | $Na_2SO_4$ | 70 g/l |
| | | pH 2~5 | |
| | C | $ZnCl_2$ | 135 g/l |
| | | $NH_4Cl$ | 150 g/l |
| | | pH 3.5~4.5 | |
| Zn—Fe | D | $ZnSO_4.7H_2O$ | 140 g/l pH 3 |
| | | $FeSO_4.7H_2O$ | 30 g/l |
| | | $CH_3COONa$ | 15 g/l |
| Zn—Ni | E | $ZnSO_4.7H_2O$ | 100 g/l pH 2 |
| | | $NiSO_4.7H_2O$ | 220 g/l |
| | | $Na_2SO_4$ | 70 g/l |
| Zn—Cr | F | $ZnSO_4.7H_2O$ | 150 g/l pH 3 |
| | | $Cr_2(SO_4)_3.18H_2O$ | 20 g/l |
| | | $NH_4Cl$ | 200 g/l |
| Zn—Sn | G | $ZnSO_4.7H_2O$ | 50 g/l pH 4 |
| | | $SnSO_4$ | 20 g/l |
| | | phenolsulfonic acid | 30 g/l |
| Zn—Mn | H | $ZnCl_2$ | 100 g/l pH 3 |
| | | $MnCl_2.4H_2O$ | 50 g/l |
| | | $NH_4Cl$ | 30 g/l |

TABLE 1-continued

| Plating bath | Symbol | Composition of plating bath | |
|---|---|---|---|
| Zn—Co | I | $ZnSO_4.7H_2O$ | 70 g/l pH 4 |
| | | $CoSO_4.7H_2O$ | 10 g/l |
| | | $H_3BO_3$ | 20 g/l |
| Zn—Mo | J | $ZnSO_4.7H_2O$ | 100 g/l pH 3 |
| | | $MoSO_4.7H_2O$ | 20 g/l |
| | | $Na_2SO_4$ | 30 g/l |
| Zn—Mg | K | $ZnSO_4.7H_2O$ | 80 g/l pH 3 |
| | | $MgSO_4.5H_2O$ | 30 g/l pH 3 |
| | | $Na_2SO_4$ | 30 g/l |

TABLE 2

| Symbol | Compounds | Molecular weight | Polar group density (for molecular weight unit of 500) | |
|---|---|---|---|---|
| a | Na salt of novolac resin sulfonate | about 1,200 | sulfo group | 3.8 |
| b | Na salt of m-cresol methylenesulfonic acid/formalin condensate | about 1.500 | sulfo group | 3 |
| c | formalin condensate of sodium m-cresol bakelite methylenesulfonate and Schaffer's acid | about 3,000 | sulfo group | 2 |
| d | formalin condensate of sodium dihydroxynaphthalene-sulfonate | 3,000 | sulfo group | 1.8 |
| e | sodium polytannic acid sulfonate | about 20,000 | sulfo group | 2 |
| f | formalin condensate of sodium phenylphenoldisulfonate | 6,000 | sulfo group | 3.4 |
| g | sodium ligninsulfonate (1) | about 10,000 | sulfo group | 1.1 |
| h | sodium ligninsulfonate (2) | about 3,600 | sulfo group | 1.3 |
| i | sodium ligninsulfonate chelate of Cr | about 5,000 | sulfo group | 1.3 |
| j | ammonium ligninsulfonate | about 2,000 | sulfo group | 1.4 |
| k | sodium poly-p-hydroxystyrenesulfonate | about 20,000 | sulfo group | 3 |
| l | sodium poly-p-hydroxystyrenesulfonate | about 10,000 | sulfo group | 2.2 |
| m | sodium poly-p-hydroxystyrenesulfonate | about 6,500 | sulfo group | 1.3 |
| n | sodium salt of brominated poly-p-hydroxystyrene sulfonate | about 12,000 | sulfo group | 1.6 |
| o | sodium poly-p-hydroxyvinylpyridinesulfonate | about 20,000 | sulfo group | 2 |
| p | sodium salt of sulfonate of reaction product of bisphenol A and epichlorohydrin | about 1,500 | sulfo group | 2 |
| q | amination [—$CH_2N(CH_3)_2$] product of compound g | about 11,000 | sulfo group<br>amino group | 1.1<br>1.2 |
| r | amination [—$CH_2N(CH_3)_2$] product of compound l which is further neutralized with acetic acid | about 16,000 | sulfo group<br>amino group | 2.1<br>2.1 |
| s | ammonium nitrofumic acid sulfonate | about 10,000 | sulfo group<br>carboxyl group | 1.2<br>1 |
| t | sodium salt of poly-p-hydroxystyrene/maleic acid copolymer | about 4,000 | carboxyl group | 4.2 |
| u | sodium diethyl(p-styrene) thiophosphate sulfonate | about 20,000 | sulfo group<br>phosphoric acid group | 0.8<br>1.5 |
| v | sodium salt of sulfonate of formalin condensate of phenylphosphonic acid and phenol | about 3,000 | sulfo group<br>phosphoric acid group | 3<br>1 |
| RA | gelatin | about 60,000 | — | |
| Rb | sodium ethylene oxide methoxylated naphthol sulfonate | about 2,000 | — | |
| Rc | sodium polyacrylate | about 30,000 | — | |
| Rd | polyethyleneimine | about 3,000 | — | |
| Re | polyethylene glycol nonylphenyl ether | about 5,000 | — | |
| Rf | sodium lignisulfonate | about 700 | sulfo group | 0.2 |
| Rg | dark molasses | — | — | |
| Rh | sodium naphthalenedisulfonate | 342 | — | |
| Ri | benzoquine | 108 | — | |
| Rj | oleic acid | 282 | | |

TABLE 3

| Symbol | Dispersed grains | Grain diameter |
|---|---|---|
| a' | $Al_2O_3$ | about 0.1μ |
| b' | $SiO_2$ | about 0.02μ |
| c' | SiC | about 0.7μ |
| d' | WC | about 1μ |
| e' | BN | about 1μ |
| f' | $MoS_2$ | about 0.1μ |
| g' | $BaCrO_4$ | about 1μ |
| h' | $Cr_3C_2$ | about 0.5μ |
| i' | epoxy resin | about 0.1μ |
| j' | polyester resin | about 0.5μ |
| k' | phenolic resin | about 0.2μ |

TABLE 3-continued

| Symbol | Dispersed grains | Grain diameter |
|---|---|---|
| l' | poly-p-vinylphenol | about 0.6μ |

TABLE 4

| | No. | Plating conditions: Plating bath | Polymer added: Kind | Polymer added: Amount (g/l) | *1 Amount of code-posited polymer (wt %) | Adhesion to paint: *2 Cross-cut adhesion test | *3 Erichsen extrusion test | *4 Water-resistant adhesion | *5 Corro-sion resist-ance | Average crystal grain diameter (μ) |
|---|---|---|---|---|---|---|---|---|---|---|
| Present invention | 1 | A | g | 2 | 0.1 | 100/100 | ◎ | ○ | Δ | 0.8 |
| | 2 | " | g | 3 | 0.2 | 100/100 | ◎ | ◎ | ○ | 0.4 |
| | 3 | B | a | 10 | 0.8 | 100/100 | ◎ | ◎ | ◎ | 1.5 |
| | 4 | " | d | 30 | 1.8 | 100/100 | ◎ | ◎ | ◎ | 0.8 |
| | 5 | " | e | 10 | 1.1 | 100/100 | ◎ | ◎ | ◎ | 1.5 |
| | 6 | " | g | 10 | 0.9 | 100/100 | ◎ | ◎ | ◎ | 0.05 |
| | 7 | " | h | 50 | 1.8 | 100/100 | ◎ | ◎ | ◎ | 0.04 |
| | 8 | " | l | 10 | 0.7 | 100/100 | ◎ | ◎ | ◎ | 0.04 |
| | 9 | " | l | 20 | 1.2 | 100/100 | ◎ | ◎ | ◎ | 0.5 |
| | 10 | " | m | 20 | 0.9 | 100/100 | ◎ | ◎ | ◎ | 1.0 |
| | 11 | " | q | 10 | 1.3 | 100/100 | ◎ | ◎ | ◎ | 0.04 |
| | 12 | " | r | 15 | 1.5 | 100/100 | ◎ | ◎ | ◎ | 0.04 |
| | 13 | " | s | 20 | 1.1 | 100/100 | ◎ | ◎ | ◎ | 3.6 |
| | 14 | " | t + g | 10 + 10 | 2.4 | 100/100 | ◎ | ◎ | ◎ | 0.05 |
| | 15 | C | b | 30 | 1.6 | 100/100 | ◎ | ◎ | ◎ | 1.5 |
| | 16 | " | f | 10 | 0.8 | 100/100 | ◎ | ◎ | ◎ | 1.0 |
| | 17 | " | j | 200 | 9.0 | 100/100 | ◎ | ◎ | ○ | 0.6 |
| | 18 | " | g + n | 10 + 5 | 1.0 | 10/100 | ◎ | ◎ | ◎ | 0.5 |
| | 19 | D | c | 5 | 0.5 | 100/100 | ◎ | ◎ | ◎ | 1.0 |
| | 20 | " | g | 20 | 1.5 | 100/100 | ◎ | ◎ | ◎ | 0.04 |
| | 21 | " | p | 10 | 1.1 | 100/100 | ◎ | ◎ | ◎ | 0.8 |
| | 22 | " | u | 5 | 0.6 | 100/100 | ◎ | ◎ | ◎ | 1.2 |
| | 23 | E | a | 5 | 0.4 | 100/100 | ◎ | ◎ | ◎ | 0.3 |
| | 24 | " | d | 10 | 0.9 | 100/100 | ◎ | ◎ | ◎ | 0.1 |
| | 25 | " | e | 10 | 0.8 | 100/100 | ◎ | ◎ | ◎ | 0.1 |
| | 26 | " | g | 20 | 1.6 | 100/100 | ◎ | ◎ | ◎ | 0.03 |
| | 27 | " | i | 10 | 0.9 | 100/100 | ◎ | ◎ | ◎ | 0.04 |
| | 28 | " | k | 30 | 2.2 | 100/100 | ◎ | ◎ | ◎ | 0.1 |
| | 29 | " | l + g | 10 + 10 | 1.8 | 100/100 | ◎ | ◎ | ◎ | 0.06 |
| | 30 | " | m | 10 | 0.8 | 100/100 | ◎ | ◎ | ◎ | 0.2 |
| | 31 | " | n | 10 | 0.7 | 100/100 | ◎ | ◎ | ◎ | 0.08 |
| | 32 | " | r | 5 | 0.7 | 100/100 | ◎ | ◎ | ◎ | 0.04 |
| | 33 | " | s | 20 | 1.7 | 100/100 | ◎ | ◎ | ◎ | 0.5 |
| | 34 | " | v | 10 | 1.0 | 100/100 | ◎ | ◎ | ◎ | 0.08 |
| | 35 | F | c | 5 | 0.4 | 100/100 | ◎ | ◎ | ◎ | 1.0 |
| | 36 | " | h | 10 | 0.9 | 100/100 | ◎ | ◎ | ◎ | 0.1 |
| | 37 | " | r | 10 | 1.2 | 100/100 | ◎ | ◎ | ◎ | 0.05 |
| | 38 | " | t | 5 | 0.5 | 100/100 | ◎ | ◎ | ◎ | 1.5 |
| | 39 | G | d + h | 10 + 10 | 1.2 | 100/100 | ◎ | ◎ | ◎ | 0.2 |
| | 40 | " | i | 10 | 0.8 | 100/100 | ◎ | ◎ | ◎ | 0.1 |
| | 41 | " | p | 10 | 0.9 | 100/100 | ◎ | ◎ | ◎ | 1.0 |
| | 42 | " | s | 30 | 2.5 | 100/100 | ◎ | ◎ | ◎ | 0.4 |
| | 43 | H | d | 5 | 0.4 | 100/100 | ◎ | ◎ | ◎ | 0.3 |
| | 44 | " | f | 10 | 0.9 | 100/100 | ◎ | ◎ | ◎ | 0.07 |
| | 45 | " | j | 20 | 1.4 | 100/100 | ◎ | ◎ | ◎ | 0.05 |
| | 46 | " | k | 10 | 0.7 | 100/100 | ◎ | ◎ | ◎ | 0.2 |
| | 47 | I | c | 5 | 0.5 | 100/100 | ◎ | ◎ | ◎ | 0.7 |
| | 48 | " | g | 30 | 2.1 | 100/100 | ◎ | ◎ | ◎ | 0.06 |
| | 49 | " | n | 5 | 0.5 | 100/100 | ◎ | ◎ | ◎ | 0.5 |
| | 50 | " | q + r | 10 + 5 | 1.1 | 100/100 | ◎ | ◎ | ◎ | 0.04 |
| | 51 | J | f | 2 | 0.3 | 100/100 | ◎ | ◎ | ◎ | 0.1 |
| | 52 | " | h | 10 | 0.7 | 100/100 | ◎ | ◎ | ◎ | 0.06 |
| | 53 | " | m | 20 | 1.3 | 100/100 | ◎ | ◎ | ◎ | 0.5 |
| | 54 | " | t | 10 | 1.0 | 100/100 | ◎ | ◎ | ◎ | 1.0 |
| | 55 | " | s | 10 | 0.9 | 100/100 | ◎ | ◎ | ◎ | 0.5 |
| | 56 | " | c | 10 | 0.8 | 100/100 | ◎ | ◎ | ◎ | 0.6 |
| | 57 | " | h | 15 | 0.6 | 100/100 | ◎ | ◎ | ◎ | 0.06 |
| | 58 | " | k | 20 | 1.7 | 100/100 | ◎ | ◎ | ◎ | 0.2 |
| | 59 | " | u | 10 | 1.1 | 100/100 | ◎ | ◎ | ◎ | 0.8 |
| | 60 | " | v | 10 | 1.0 | 100/100 | ◎ | ◎ | ◎ | 0.1 |
| Comparative | 61 | A | — | — | — | 100/100 | x | x x | x x | 5 |
| | 62 | B | — | — | — | 100/100 | x | x x | x x | 2 |
| | 63 | C | — | — | — | 100/100 | x | x x | x x | — |
| | 64 | D | — | — | — | 100/100 | x | x x | x x | — |
| | 65 | E | — | — | — | 100/100 | Δ | x x | x | — |
| | 66 | F | — | — | — | 100/100 | x | x x | x x | — |
| | 67 | G | — | — | — | 100/100 | x | x x | x x | 2 |
| | 68 | H | — | — | — | 100/100 | x | x x | x x | 3 |
| | 69 | I | — | — | — | 100/100 | x | x x | x x | — |
| | 70 | J | — | — | — | 100/100 | x | x x | x x | — |
| | 71 | B | j | 0.5 | 0.04 | 100/100 | Δ | x | x x | — |

TABLE 4-continued

| No. | Plating conditions: Plating bath | Polymer added: Kind | Polymer added: Amount (g/l) | *1 Amount of code-posited polymer (wt %) | Adhesion to paint: *2 Cross-cut adhesion test | *3 Erichsen extrusion test | *4 Water-resistant adhesion | *5 Corro-sion resist-ance | Average crystal grain diameter (μ) |
|---|---|---|---|---|---|---|---|---|---|
| 72 | " | Ra | 5 | 0.4 | 100/100 | x | x x | x x | 5 |
| 73 | " | Rb | 20 | 1.3 | 100/100 | x | x | x x | 2 |
| 74 | " | Rc | 15 | 0.7 | 100/100 | Δ | x x | x x | — |
| 75 | " | Rd | 10 | 0.6 | 100/100 | Δ | x | x x | — |
| 76 | " | Re | 20 | 1.3 | 100/100 | x | x x | x | — |
| 77 | " | Rf | 15 | 1.0 | 100/100 | Δ | x | x x | — |
| 78 | " | j + rg | 10 + 5 | 0.9 | 100/100 | x | x | x x | 1.1 |
| 79 | D | Rb | 20 | 1.4 | 100/100 | x | x | x x | — |
| 80 | " | Rc | 5 | 0.4 | 100/100 | Δ | x | x x | — |
| 81 | " | Rd | 5 | 0.4 | 100/100 | Δ | x x | x x | — |
| 82 | " | g | 400 | 31 | 100/100 | Δ | x | x x | — |
| 83 | E | Rb | 10 | 0.7 | 100/100 | x | x | x x | 1 |
| 84 | " | j + Re | 15 + 1 | 1.3 | 100/100 | Δ | x x | x | 0.7 |
| 85 | " | Rd | 5 | 0.4 | 100/100 | Δ | x | x | — |
| 86 | " | J + Rl + Rj | 2 + 1.5 + 0.5 | 0.2 | 100/100 | Δ | x x | x | 1.2 |
| 87 | B | phosphate treatment | | — | 100/100 | O | O | x x | 5 |
| 88 | E | " | | — | 100/100 | O | O | x | 1 |
| 89 | B | chromate treatment | | — | 100/100 | Δ | Δ | Δ | 2 |
| 90 | E | " | | — | 100/100 | Δ | Δ | Δ | 1 |

TABLE 5

| No. | Substrate: Kind | | Plating bath | Composite coating: Plating bath | Polymer added: Kind | Polymer added: Amount (g/l) | Thickness of composite coating (μ) | Adhesion to paint: *2 Cross-cut adhesion test | *3 Erichsen extrusion test | *4 Water-resistant adhesion | *5 Corro-sion resist-ance |
|---|---|---|---|---|---|---|---|---|---|---|---|
| Present invention | | | | | | | | | | | |
| 91 | Electroplated | Zn | B | B | g | 10 | 0.1 | 100/100 | ◎ | ◎ | ◎ |
| 92 | steel plate | Zn—Fe | D | E | i | 10 | 0.1 | 100/100 | ◎ | ◎ | ◎ |
| 93 | | Zn—Ni | E | E | l | 10 | 0.1 | 100/100 | ◎ | ◎ | ◎ |
| 94 | | Zn—Co | I | E | r | 10 | 0.5 | 100/100 | ◎ | ◎ | ◎ |
| 95 | | Cr | — | E | h | 10 | 0.5 | 100/100 | ◎ | ◎ | ◎ |
| 96 | | Ni | — | E | i | 10 | 0.5 | 100/100 | ◎ | ◎ | ◎ |
| 97 | Hot-galvanized | Zn | — | E | l | 10 | 1.0 | 100/100 | ◎ | ◎ | ◎ |
| 98 | steel plating | Zn—Fe | — | E | r | 10 | 1.0 | 100/100 | ◎ | ◎ | ◎ |
| 99 | | Zn—Al | — | E | j | 10 | 1.0 | 100/100 | ◎ | ◎ | ◎ |
| Comparative | | | | | | | | | | | |
| 100 | Electroplated | Zn | B | — | phosphate treatment | | — | 100/100 | Δ | x x | x x |
| 101 | steel plate | Zn—Ni | E | — | phosphate treatment | | — | 100/100 | O | x | x |
| 102 | Hot-galvanized | Zn | — | — | phosphate treatment | | — | 100/100 | Δ | x x | x x |
| 103 | steel plate | Zn—Fe | — | — | phosphate treatment | | — | 100/100 | O | x | x x |

TABLE 6

| No. | Plating conditions: Plating bath | Polymer added: Kind | Polymer added: Amount (g/l) | Grains added: Kind | Grains added: Amount (g/l) | *1 Amount of code-deposited polymer (wt %) | Amount of code-deposited grains (vol %) | Adhesion to paint: *2 Cross-cut adhesion test | *3 Erichsen extrusion test | *4 Water-resistant adhesion | *5 Corro-sion resist-ance |
|---|---|---|---|---|---|---|---|---|---|---|---|
| Present invention | | | | | | | | | | | |
| 104 | B | d | 10 | a' | 50 | 0.7 | 10 | 100/100 | ◎ | ◎ | ◎ |
| 105 | B | g | 20 | b' | 100 | 0.9 | 14 | 100/100 | ◎ | ◎ | ◎ |
| 106 | B | l | 10 | c' | 50 | 0.6 | 8 | 100/100 | ◎ | ◎ | ◎ |
| 107 | B | t | 5 | f' | 50 | 0.5 | 5 | 100/100 | ◎ | ◎ | ◎ |
| 108 | B | a | 10 | h' | 50 | 0.8 | 6 | 100/100 | ◎ | ◎ | ◎ |
| 109 | E | h | 10 | a' + j' | 50 + 30 | 0.7 | 25 | 100/100 | ◎ | ◎ | ◎ |
| 110 | E. | k | 20 | k' | 50 | 1.1 | 15 | 100/100 | ◎ | ◎ | ◎ |
| 111 | E | r | 10 | a' + g' | 50 + 50 | 1.3 | 28 | 100/100 | ◎ | ◎ | ◎ |
| 112 | E | f | 10 | d' | 50 | 0.9 | 4 | 100/100 | ◎ | ◎ | ◎ |
| 113 | E | j | 10 | e' | 50 | 1.0 | 15 | 100/100 | ◎ | ◎ | ◎ |
| 114 | I | c | 10 | j' | 100 | 1.2 | 25 | 100/100 | ◎ | ◎ | ◎ |

TABLE 6-continued

| No. | Plating bath | Plating conditions: Polymer added Kind | Polymer added Amount (g/l) | Grains added Kind | Grains added Amount (g/l) | *1 Amount of code-deposited polymer (wt %) | Amount of code-deposited grains (vol %) | Adhesion to paint: *2 Cross-cut adhesion test | *3 Erichsen extrusion test | *4 Water-resistant adhesion | *5 Corrosion resistance |
|---|---|---|---|---|---|---|---|---|---|---|---|
| 115 Comparative | J | s | 20 | i' | 50 | 2.0 | 18 | 100/100 | ◎ | ◎ | ◎ |
| 116 | B | — | — | a' | 50 | — | — | 100/100 | x | x | x |
| 117 | E | — | — | b' | 50 | — | — | 100/100 | x | x | Δ |
| 118 | I | — | — | i' | 50 | — | — | 100/100 | O | x | x |

(Notes)

*1 The sample was heated to 1350° C. and the amounts of $CO_2$ and CO formed were measured with a device for analysing carbon in metals (ETMA-110; a product of Horiba Seisaku-sho) to determine the total amount of carbon (wt. %) in the electroplated coating. The amount of the codeposited organic polymer was represented in terms of this value (carbon content). In the electroplated coatings in which both water-soluble and water-insoluble organic polymers were code-posited, the coating was dissolved in an aqueous sulfuric acid solution, the solution was filtered through a membrane filter to remove the water-insoluble polymer and then the above-mentioned measurement was conducted.

*2 The sample was cross-cut at intervals of 1 mm to make 100 squares. The cutting depth was such that it reached the surface of the electroplated undercoat. The sample was subjected to a peeling test with a cellophane tape. The adhesion to the paint was represented in terms of the number of remaining squares of the paint film.

*3 The sample was cross-cut at intervals of 1 mm to make 100 squares. The cutting depth was such that it reached the surface of the electroplated undercoat. The sample was subjected to an Erichsen extrusion test (8 mm) and then to a peeling test with a cellophane tape. The result was represented in terms of the rate of the remaining paint coating. Criteria:

◎: no peeling was caused with the tape at all,

O : only slight peeling (1 to 5%) was caused with the tape,

Δ: the peeling was caused in a small amount (5 to 15%) with the tape, x: the peeling was caused considerably (15 to 35%) with the tape, and x x: the major part (65% or more) was peeled with the tape.

*4 The sample (not cross-cut) was immersed in ionexchanged water at 60° C. for 150 days and then subjected to cross-cut test *2. The results were represented in terms of the rate of the remaining paint coating. The criteria were the same as in Note *3.

*5 5% aqueous sodium chloride solution was continuously sprayed onto the coated and cross-cut test pieces for 2 weeks according to JIS 2371 and then a cross-cut part was subjected to the peeling test with the tape. Criteria:

◎: no blister was observed around 0 to 1 mm (one-side width from a cut line),

O : no blister was observed around 1 to 2 mm (one side width from a cut line),

Δ: blisters were observed around 2 to 4 mm (one-side width of a cut line), x: considerable blisters were observed around 4 to 10 mm (one-side width of a cut line), and x x: the whole surface was peeled off (one-side width of a cut line).

Effects of the Invention

A great feature of the present invention resides in the use of the water-soluble organic polymer having the specified chemical structure as described above. Since the molecular composite of the electroplated metal and the organic polymer is formed in the plating bath of the present invention, excellent adhesion to the paint and corrosion resistance can be provided with only a relatively small amount of the organic polymer codeposited. Therefore, the electroplated coating can be painted directly without necessitating any chemical pretreatment of the prime coat with a phosphate or chromate which has been usually employed in the prior art. Thus, by employing the plating bath of the present invention, the troublesome chemical treatment which necessitates a countermeasure to an environmental pollution can be omitted. The industrial merit of this is great.

Further, painted, electroplated metallic materials having no chemically treated brittle layer thus prepared can be used in the preparation of ideal precoated steel sheets usable as a material in the production of household electric appliances or construction materials which exert an excellent press workability after painting.

Since the coating of the present invention has particularly excellent adhesion to the paint and corrosion resistance after painting, in addition to excellent press workability and weldability, it is possible to produce a rust-proofing steel plate having an extremely excellent corrosion resistance by employing the coating technique in the production of a rust-proofing automobile steel sheets.

The coating of the present invention is usable not only as a prime coat for painting but also as a prime coat to be laminated with a rubber, organic film or ceramic.

The composite coating of the water-soluble organic polymer and zinc or zinc alloy can be easily produced in an ordinary electroplating apparatus without necessitating expensive equipment or much labor. The present invention has thus a high industrial value.

What is claimed is:

1. An electroplated composite coating which comprises 70 to 99.9 percent by weight of an organic polymer, said polymer being soluble in water and anionic, cationic or amphoteric and dispersed in the electroplated crystal grains or grain boundaries of the zinc and/or the zinc alloy and having a weight-average molecular weight of 1,000 to 1,000,000, said polymer having at least one aromatic ring and 1 to 10 hydroxyl groups on the average per molecular weight unit of 500, said polymer containing therein a polar group selected from the group consisting of:

a sulfo group, a phosphoric acid group of the formula —O—PO-(OR)2, a phosphorous acid group of the formula —O—P-(OR)2, a phosphonic acid group of the formula —PO(OR)2, a phosphonous acid group of the group —P(OR)2, phosphinic acid group of the formula —RPO(OR),
a phosphinous acid group of the formula —PR(OR),
a tertiary amino group of the formula —NR1R2,
a quaternary ammonium group of the formula [—NR1R2R3.X] —NR1R2R3 X and a
carboxyl group having the formula —COOH,
in which R is hydrogen or a hydrocarbon group and R1, R2 and R3 each are a straight or branched alkyl, a straight or branched hydroxyalkyl or an aromatic ring and X is a counter anion,
the sulfo group being contained therein on the average in an amount of 0.1 to 4 sulfo groups per molecular weight unit of 500, the other groups being contained therein on the average in a total amount of 0.1 to 5 groups per molecular weight unit of 500,
the main chain bridging between two aromatic rings being at least one of C—C linkage, C=C linkage and an ether linkage (C—0—C).

2. A composite coating as claimed in claim 1, wherein the aromatic ring in the water-soluble organic polymer has at least one hydroxyl group as a substituent.

3. A composite coating as claimed in claim 1, wherein the water-soluble organic polymer contained in the electroplated coating comprises at least one water-soluble anionic organic polymer having a weight-average molecular weight of 1,000 to 1,000,000 and at least one aromatic ring, 1 to 10 hydroxyl groups (—OH) on average and 0.to 4 sulfo groups (—$SO_3$) on average for a molecular weight unit of 500 as indispensable components and the main chain bonding the aromatic rings together comprises at least one of C—C linkage, C=C linkage and ether linkage (C—O—C).

4. A composite coating as claimed in claim 1 wherein the water-soluble organic polymer contained in the electroplated coating is at least one water-soluble anionic organic polymer having a weight-average molecular weight of 1,000 to 1,000,000 and at least one aromatic ring having at least one hydroxyl group as a substituent and 0.1 to 4 sulfo groups on average for a molecular weight unit of 500 and the main chain bonding the aromatic rings together is at least one of C—C linkage, C=C linkage and ether linkage (C—0—C).

5. A composite coating as claimed in claim 1 wherein the average diameter of the crystal grains in the electroplated coating is 10μ to 50 Å.

6. A composite coating as claimed in claim 1 wherein the average diameter of the crystal grains in the electroplated coating is 5,000 to 50 Å.

7. A composite coating as claimed in claim 1 wherein the average diameter of the crystal grains in the electroplated coating is 1,000 to 50 Å.

8. A composite coating as claimed in claim 1 wherein the average diameter of the crystal grains in the electroplated coating is I,000 to 50 Å and the crystals are nearly spherical or ellipsoidal.

9. A composite coating as claimed in claim 1, characterized by containing 1 to 30 vol. %, based on the total plated coating, of ceramic particles or at least one water-insoluble organic polymer.

10. A process for electroplating zinc or an alloy of zinc and an organic polymer on the surface of a conductive substrate together with an organic polymer, characterized in that the conductive substrate, functioning as a cathode, is electroplated in a plating bath to codeposit a metal and a water-soluble organic polymer on the surface of the substrate, the amount of the water-soluble organic polymer being adjusted to 0.1 to 30 wt. % based on the total codeposit, and the plating bath being a zinc plating bath containing 10 to 600 g/l of zinc ion or a zinc alloy plating bath containing one or more metals other than zinc, each metal being contained in an amount of 1 to 600 g/l, in addition to zinc, said coating bath further containing, as indispensable components, 2 to 200 g/l in total of at least one organic polymer as defined in claim 1.

11. A process according to claim 10, characterized in that a conductive substrate functioning as a cathode is electroplated in a plating bath to codeposit a metal, a water-soluble organic polymer and ceramic particles or a water-insoluble resin on the surface of the substrate, the amount of the water-soluble organic polymer being adjusted to 0.1 to 30 wt. % based on the total codeposit and the amount of the ceramic or water-insoluble organic polymer being adjusted to 1 to 30 vol. % based on the total codeposit, the plating bath being a dispersion plating bath which further contains water-insoluble ceramic particles or at least one water-insoluble organic polymer.

12. A process according to claim 10 wherein the aromatic ring in the water-soluble organic polymer has at least one hydroxyl group as a substituent.

13. A rpocess according to claim 10 wherein the water-soluble organic polymer to be added is at least one water-soluble anionic organic polymer having a weight-average molecular weight of a 1,000 to 1,000,000 and at least one aromatic ring, 1 to 10 hydroxyl groups (—OH) on average and 0.1 to 4 sulfo groups (—$SO_3$) on average for a molecular weight unit of 500 as indispensable components and the main chain bonding the aromatic rings together is at least one of C—C linkage, C=C linkage and ether linkage (C—O—C).

14. A process according to claim 10 wherein the water-soluble organic polymer to be added is at least one water-soluble anionic organic polymer having a weight-average molecular weight of 1,000 to 1,000,000 and at least one aromatic ring having at least one hydroxyl group as a substituent and 0.1 to 4 sulfo groups on average for a molecular weight unit of 500 and the main chain bonding the aromatic rings together is at least one of C—C linkage, C=C linkage and ether linkage (C—O—C).

15. A process according to claim 10 wherein the conductive substance used as the cathode is a metallic material such as a steel plate, copper plate or lead plate.

16. A process according to claim 10 wherein the conductive substance used as the cathode is a steel plate the surface of which has already been electroplated and hot galvanized.

17. An electroplated article obtained by the process defined in claim 10.

* * * * *

UNITED STATES PATENT AND TRADEMARK OFFICE

CERTIFICATE OF CORRECTION

PATENT NO. : 4 797 183

DATED : January 10, 1989

INVENTOR(S) : Yuzo YAMAMOTO et al

It is certified that error appears in the above-identified patent and that said Letters Patent is hereby corrected as shown below:

Column 31, line 28; change "0.to" to ---0.1 to---.

Column 32, line 31; change "rpocess" to ---process---.

Signed and Sealed this

Twenty-eighth Day of November 1989

*Attest:*

JEFFREY M. SAMUELS

*Attesting Officer* *Acting Commissioner of Patents and Trademarks*

UNITED STATES PATENT AND TRADEMARK OFFICE

CERTIFICATE OF CORRECTION

PATENT NO. : 4 797 183

DATED : January 10, 1989

INVENTOR(S) : Yuzo YAMAMOTO et al

It is certified that error appears in the above-identified patent and that said Letters Patent is hereby corrected as shown below:

Column 30, line 50; after "weight" insert ---of zinc or an alloy of zinc and 0.1 to 30 percent by weight---.

Column 31, line 1; before "phosphinic" insert ---a---.

Column 32, line 34; delete "a".

Signed and Sealed this

Fifth Day of March, 1991

*Attest:*

*Attesting Officer*

HARRY F. MANBECK, JR.

*Commissioner of Patents and Trademarks*